US007503440B2

(12) United States Patent
Gormick et al.

(10) Patent No.: US 7,503,440 B2
(45) Date of Patent: Mar. 17, 2009

(54) MULTI-FUNCTION TRAVEL CASE

(75) Inventors: Todd M. Gormick, Rancho Santa Margarita, CA (US); Stanley H. Wada, Venice, CA (US); Hrag Nassanian, Portland, OR (US); Grace Chang, Los Angeles, CA (US); Hing Yeung, Los Angeles, CA (US); Alex Rochat, Pasadena, CA (US)

(73) Assignee: Targus Group International, Inc., Anaheim, CA (US)

( * ) Notice: Subject to any disclaimer, the term of this patent is extended or adjusted under 35 U.S.C. 154(b) by 796 days.

(21) Appl. No.: 10/939,346

(22) Filed: Sep. 14, 2004
(Under 37 CFR 1.47)

(65) Prior Publication Data

US 2005/0072644 A1 Apr. 7, 2005

Related U.S. Application Data

(60) Provisional application No. 60/507,130, filed on Oct. 1, 2003.

(51) Int. Cl.
*A45C 13/18* (2006.01)
*A45C 13/42* (2006.01)
*A45C 13/02* (2006.01)

(52) U.S. Cl. ..... 190/102; 190/18 R; 190/109; 190/111; 206/320

(58) Field of Classification Search ..... 190/18 R, 190/102, 109–111; 206/320; 362/155

See application file for complete search history.

(56) References Cited

U.S. PATENT DOCUMENTS

| | | | | |
|---|---|---|---|---|
| 2,316,328 A | | 4/1943 | Guenther et al. | |
| 3,286,751 A | | 11/1966 | Dishart | |
| 3,497,041 A | * | 2/1970 | Samhammer | 190/18 R |
| 4,722,376 A | | 2/1988 | Rhyner | |
| 4,817,769 A | | 4/1989 | Saliba | |
| 4,828,081 A | | 5/1989 | Nordstrom et al. | |
| 5,150,776 A | | 9/1992 | Rebenack | |
| 5,217,119 A | | 6/1993 | Hollingsworth | |

(Continued)

OTHER PUBLICATIONS

International Search Report issued Jan. 6, 2005 for Appln. No. PCT/US04/32434, 14 pages.

(Continued)

*Primary Examiner*—Sue A Weaver
(74) *Attorney, Agent, or Firm*—John R. Thompson; Stoel Rives LLP

(57) ABSTRACT

A multi-function travel case includes a plurality of features for facilitating ease of travel, including a retractable document sleeve for storing important travel-related documents in a manner that allows for quick, secure and easy access, viewing and storage of same during travel. The travel case further includes a retractable bottle holder extendable from a side pocket thereof, a side storage compartment adapted for storing eyeglasses in a manner that prevents scratching of same, a front interior storage compartment that houses a retractable light source, a key holder, and integrated pockets adapted for the storage of optical media without scratching the same, a central interior storage compartment having an adjustable top restraint and first and second user-positionable, impact resistant, adjustable cushions for securing portable computer devices of different sizes, a rear interior storage compartment having a removable file folder housed therein, ergonomically-designed rubber handles, and anti-tip feet.

16 Claims, 25 Drawing Sheets

U.S. PATENT DOCUMENTS

| | | | | |
|---|---|---|---|---|
| 5,524,754 | A | 6/1996 | Hollingsworth | |
| 5,555,960 | A | 9/1996 | Bartsch | |
| 5,676,223 | A | 10/1997 | Cunningham | |
| 5,678,666 | A | 10/1997 | Shyr et al. | |
| 5,706,935 | A | 1/1998 | Lorton | |
| 5,762,170 | A | 6/1998 | Shyr et al. | |
| 5,788,032 | A | 8/1998 | Krulik | |
| 5,826,770 | A | 10/1998 | Chuang | |
| 5,833,352 | A | 11/1998 | Goodwin | |
| 5,881,850 | A | 3/1999 | Murdoch | |
| 5,887,777 | A | 3/1999 | Myles et al. | |
| 5,908,147 | A | 6/1999 | Chuang | |
| 5,967,270 | A | 10/1999 | Shyr | |
| 6,024,054 | A | 2/2000 | Matt et al. | |
| 6,062,356 | A | 5/2000 | Nykoluk | 190/18 R |
| 6,062,357 | A | 5/2000 | Bogert | |
| 6,098,768 | A | 8/2000 | Tsai | |
| 6,105,763 | A | 8/2000 | Saetia | |
| 6,131,734 | A | 10/2000 | Hollingsworth et al. | |
| 6,145,337 | A | 11/2000 | Wilson | |
| 6,145,661 | A | 11/2000 | Jung | |
| 6,179,431 | B1 | 1/2001 | Chien | |
| 6,193,118 | B1 | 2/2001 | Kearl | |
| 6,213,267 | B1 | 4/2001 | Miller | |
| 6,227,339 | B1 * | 5/2001 | Bogert | 190/18 R |
| 6,257,407 | B1 | 7/2001 | Truwit et al. | |
| 6,295,650 | B1 | 10/2001 | Baacke | |
| 6,318,552 | B1 | 11/2001 | Godshaw | |
| 6,354,477 | B1 | 3/2002 | Trummer | |
| 6,360,402 | B1 | 3/2002 | Crabtree | |
| 6,390,297 | B1 | 5/2002 | Hollingsworth | |
| 6,629,588 | B2 * | 10/2003 | Nykoluk et al. | 190/102 |
| 2003/0042091 | A1 | 3/2003 | Oh | |

OTHER PUBLICATIONS

Office Action for U.S. Appl. No. 10/939,333, filed Sep. 14, 2004, mailed from the USPTO on Apr. 7, 2008, 15 pgs.

* cited by examiner

MULTI-FUNCTION TRAVEL CASE

CROSS-REFERENCE TO RELATED APPLICATIONS

This application claims the benefit of the filing date of U.S. Provisional Application No. 60/507,130, filed Oct. 1, 2003, the entirety of which is incorporated by reference as if set forth fully herein.

This application is related to commonly owned copending U.S. patent application Ser. No. to be assigned, also entitled "Multi-Function Travel Case", filed on the same date as the present application.

BACKGROUND OF THE INVENTION

1. Field of the Invention

The present invention relates generally to carrying cases, and in particular, carrying cases that provide one or more features for facilitating ease of travel.

2. Background

Conventional carrying cases, such as conventional cases for carrying portable computers, do not provide a combination of features for facilitating ease of travel as provided by the invention described herein.

For example, modem travel, and in particular modem airline travel, involves heightened security procedures that require a traveler to provide one or more important documents, such as an airline ticket, boarding pass, passport and/or other identification, at one or more checkpoints during a trip. Constantly accessing and presenting these documents can be inconvenient and time-consuming for the traveler. Moreover, each time the documents are removed and returned to storage, the traveler runs the risk of dropping or misplacing them, particularly when in a hurry. Conventional carrying cases do not provide a means for storing such important travel-related documents in a manner that allows for quick, secure and easy access, viewing and storage of same during travel.

BRIEF SUMMARY OF THE INVENTION

A multi-function travel case in accordance with the present invention includes a plurality of features for facilitating ease of travel. For example, a travel case in accordance with an embodiment of the present invention includes a retractable document sleeve for storing important travel-related documents such as airline tickets, a passport, or other identification information, in a manner that allows for quick, secure and easy access, viewing and storage of same during travel.

A multi-function travel case in accordance with an embodiment of the present invention further includes one or more of the following features: a retractable bottle holder that is extendable from a side pocket thereof, a side storage compartment adapted for storing eyeglasses, sunglasses, and the like, in a manner that prevents scratching of same, a front interior storage compartment that houses an retractable light source, a key holder, and integrated pockets adapted for the storage of optical media without scratching the same, a central interior storage compartment having an adjustable top restraint for securing portable computer devices of different sizes and first and second user-positionable, impact resistant, adjustable cushions for supporting a portable computer device, a rear interior storage compartment having a removable file folder housed therein, ergonomically-designed rubber handles, and anti-tip feet.

Further features and advantages of the invention, as well as the structure and operation of various embodiments of the invention, are described in detail below with reference to the accompanying drawings. It is noted that the invention is not limited to the specific embodiments described herein. Such embodiments are presented herein for illustrative purposes only. Additional embodiments will be apparent to persons skilled in the relevant art(s) based on the teachings contained herein.

BRIEF DESCRIPTION OF THE DRAWINGS/FIGURES

The accompanying drawings, which are incorporated herein and form part of the specification, illustrate the present invention and, together with the description, further serve to explain the principles of the invention and to enable a person skilled in the relevant art(s) to make and use the invention.

FIG. 6 is a broken side perspective view of the multi-function travel case showing the first side storage compartment opened to reveal an interior area adapted, in part, for the storage of sunglasses, eyeglasses, and the like.

FIGS. 12A, 12B, 12C, and 12D are a side, cross-sectional, bottom and front view, respectively, of an anti-tip foot of the multi-function travel case.

Figure 13:
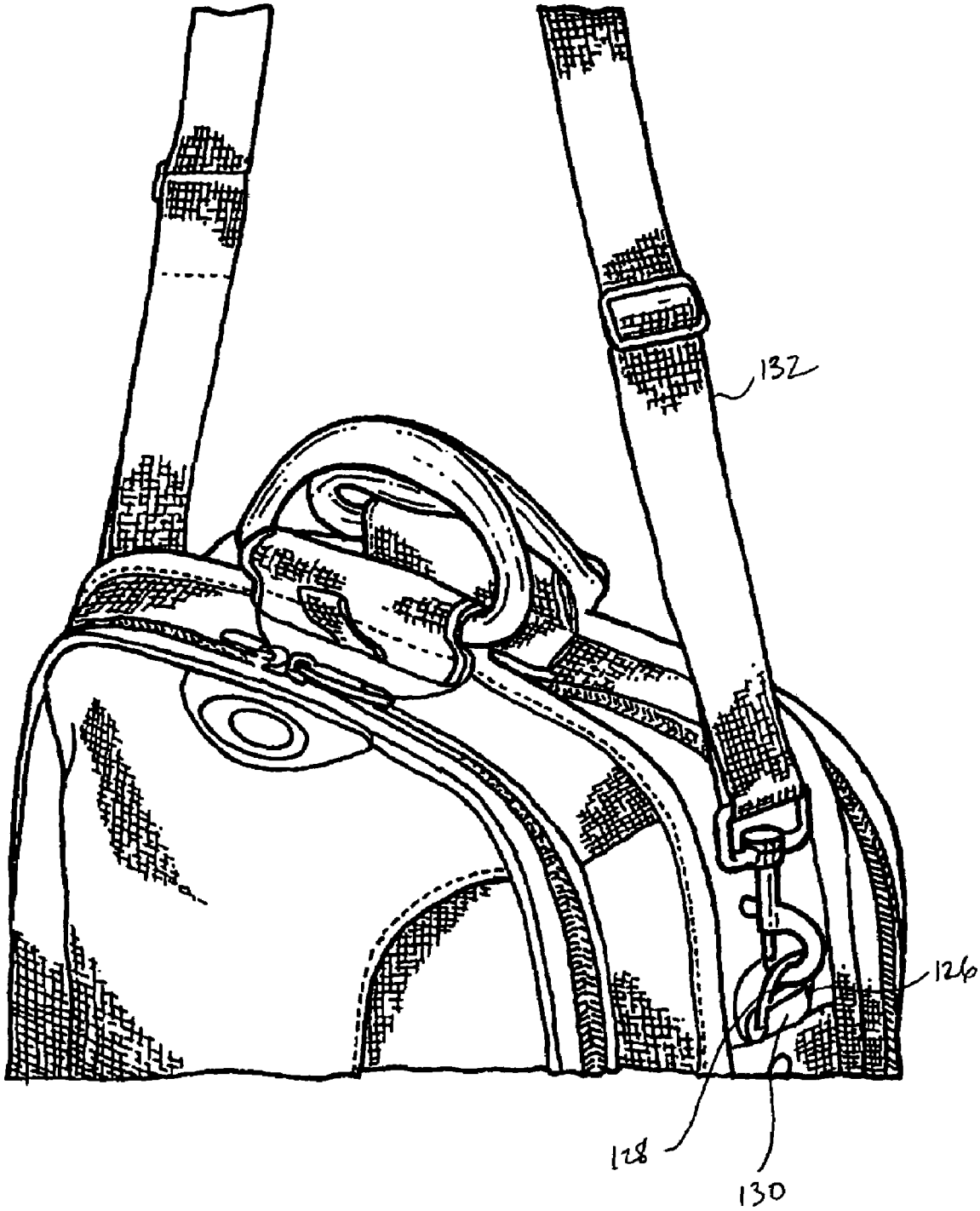

FIG. 13 is a broken perspective view of the multi-function travel case showing a detachable shoulder strap coupled thereto.

Figure 14:
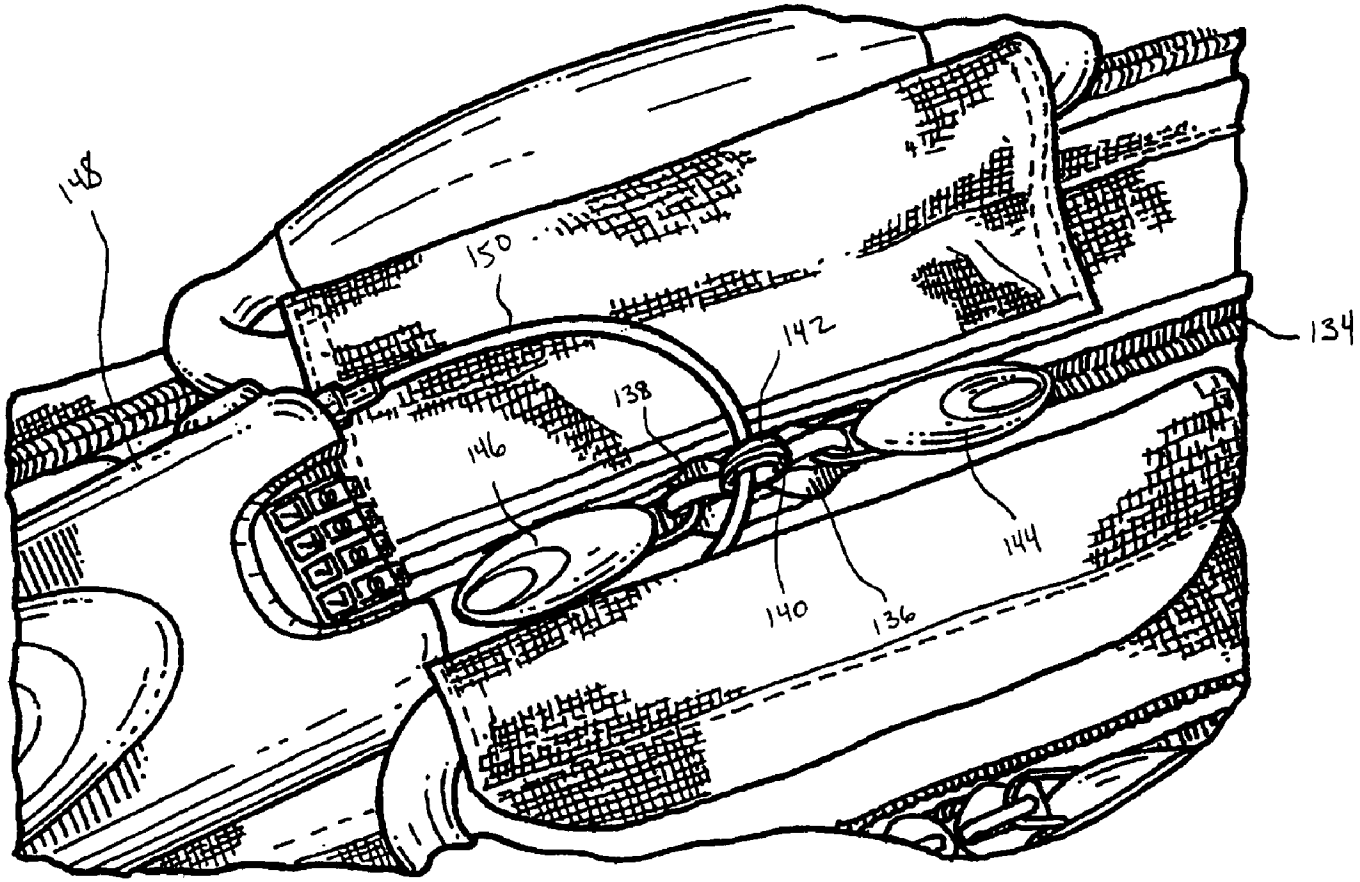

FIG. 14 is a broken top view of the multi-function travel case illustrating first and second zipper sliders for sealing an interior compartment thereof, the first and second zipper sliders engaged in a cooperative mating position for receiving a locking apparatus.

Figure 15:
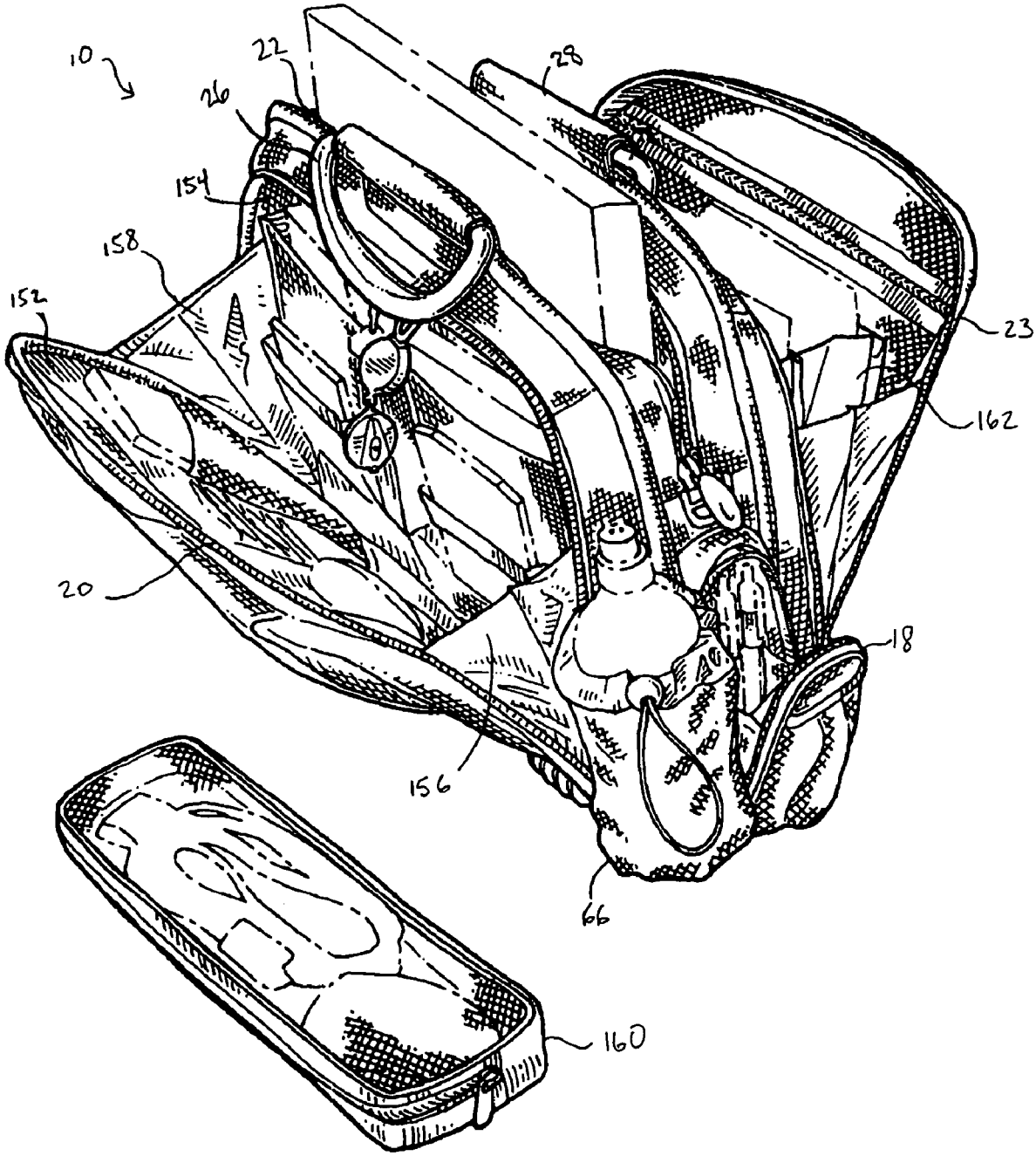

FIG. 15 is a top perspective view of the multi-function travel case illustrating opened front, center and rear interior storage compartments thereof, opened side storage compartment thereof, and retractable water bottle holder extended from a side pocket thereof.

Figure 16:
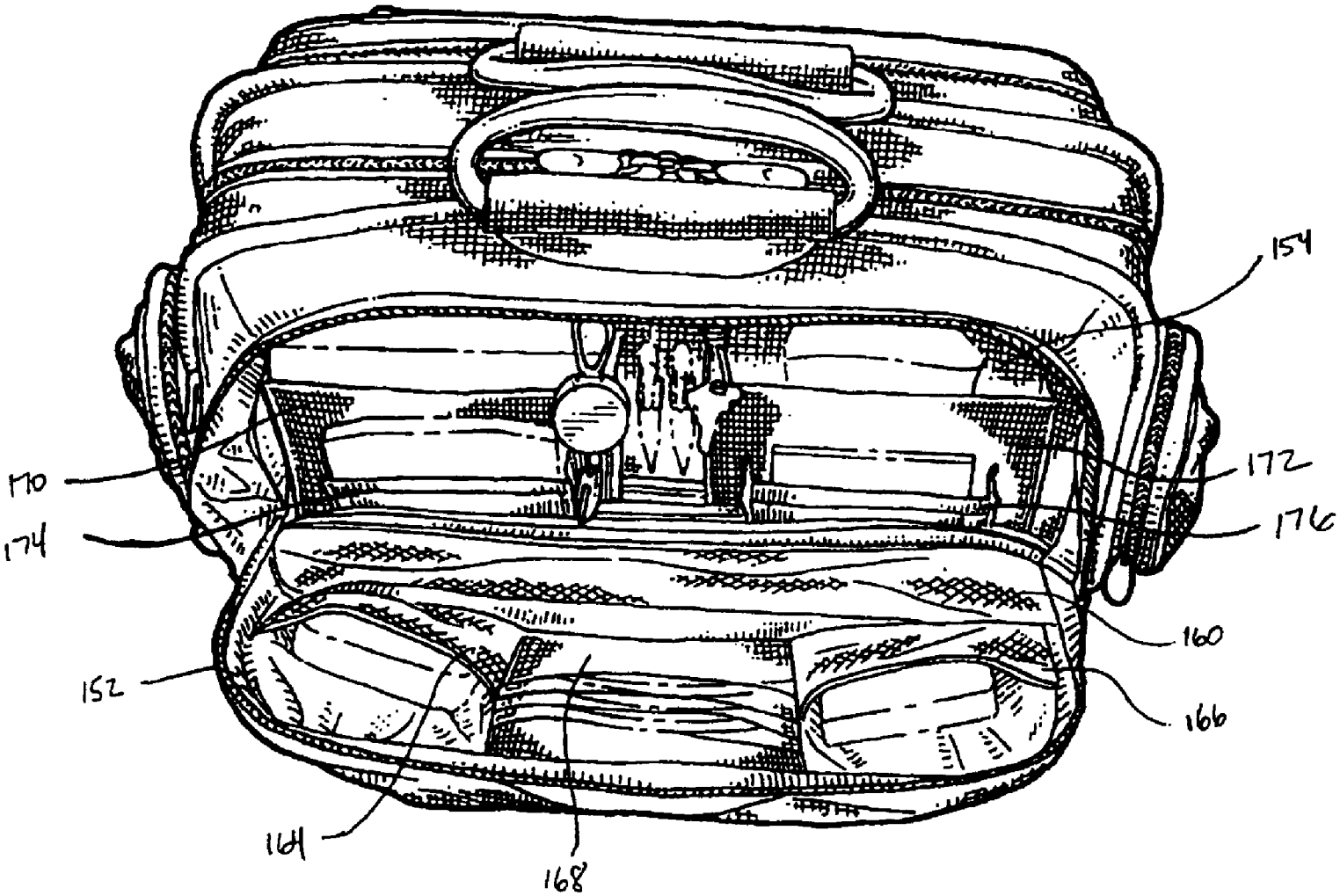

FIG. 16 is a top perspective view of the multi-function travel case illustrating an opened front interior storage compartment thereof.

Figure 17:
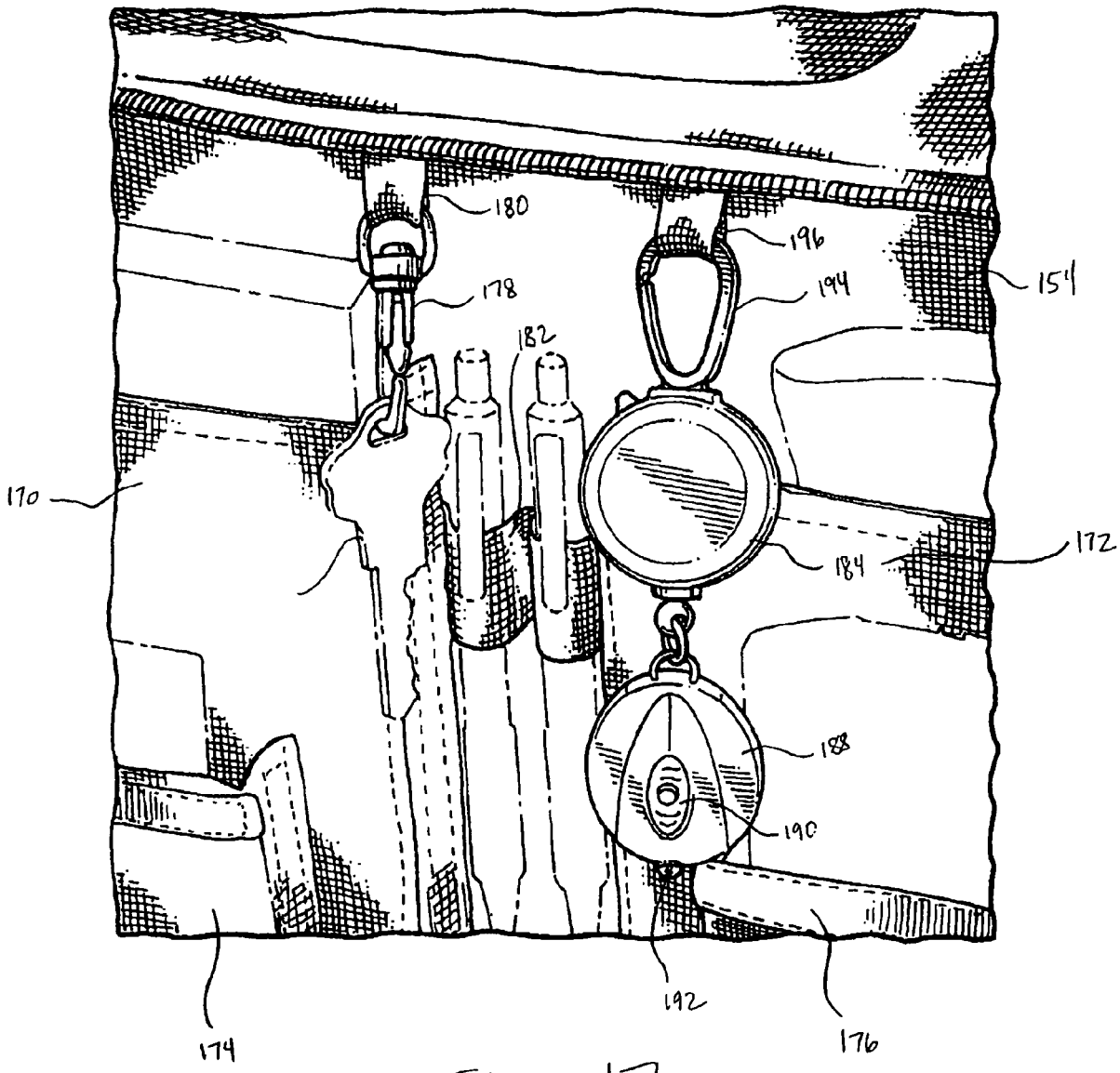

FIG. 17 is a broken front perspective view of the multi-function travel case showing an opened front interior storage compartment thereof, the interior of the opened front interior storage compartment having a key holder and a retractable light coupled thereto.

Figure 18:
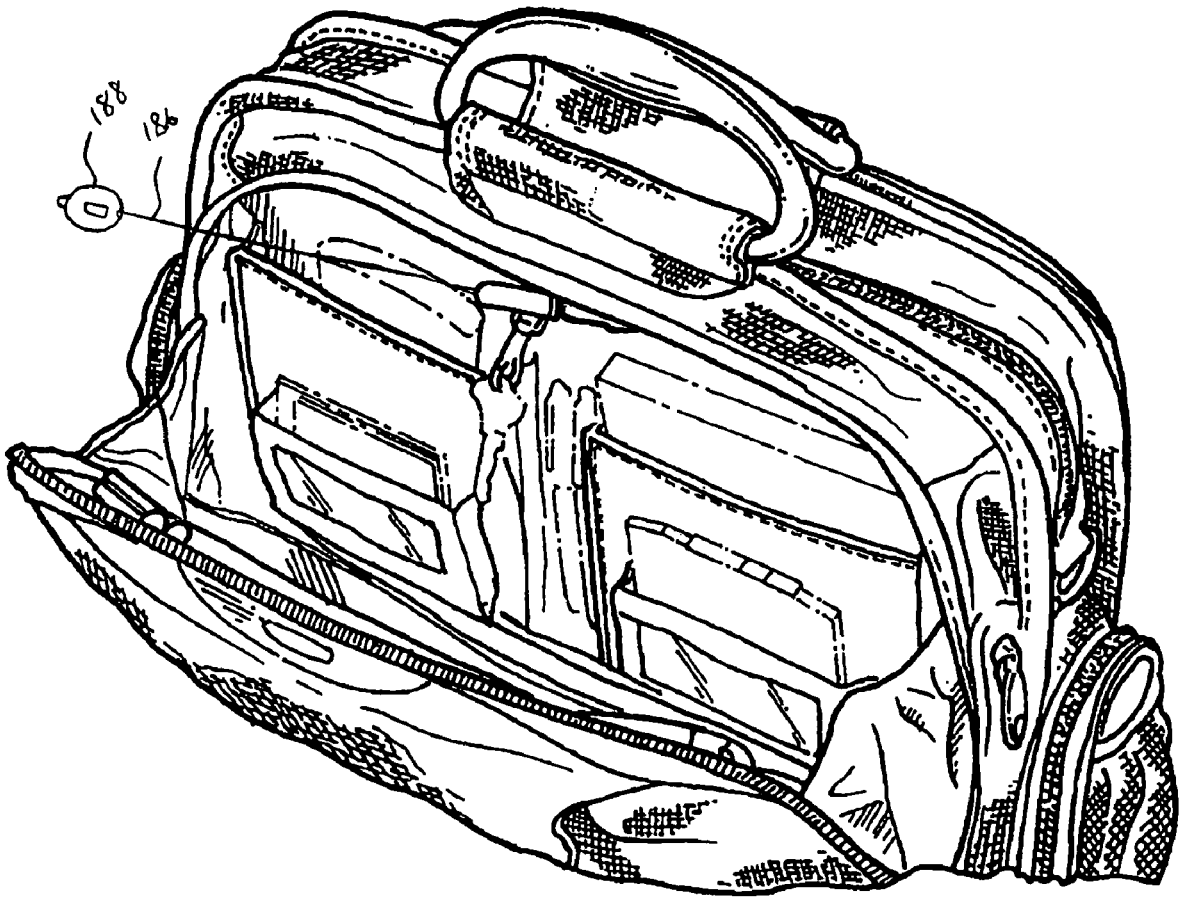

FIG. 18 is a top perspective view of the multi-function travel case showing the retractable light in an extended position.

Figure 19:
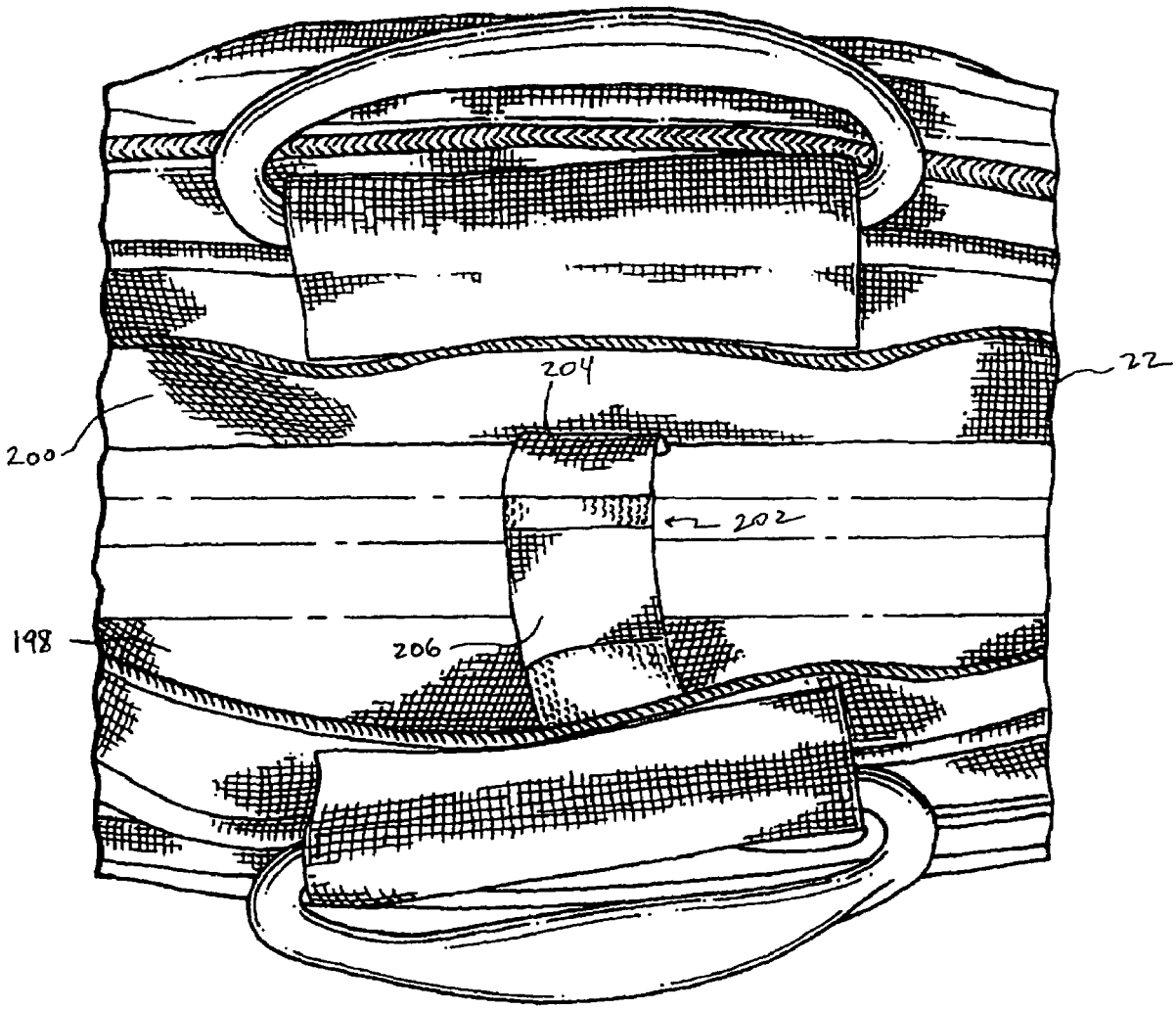

FIG. 19 is a broken top view of the multi-function travel case showing an opened central interior storage compartment thereof having an adjustable top restraint for securing portable computer devices of different sizes.

Figure 20:
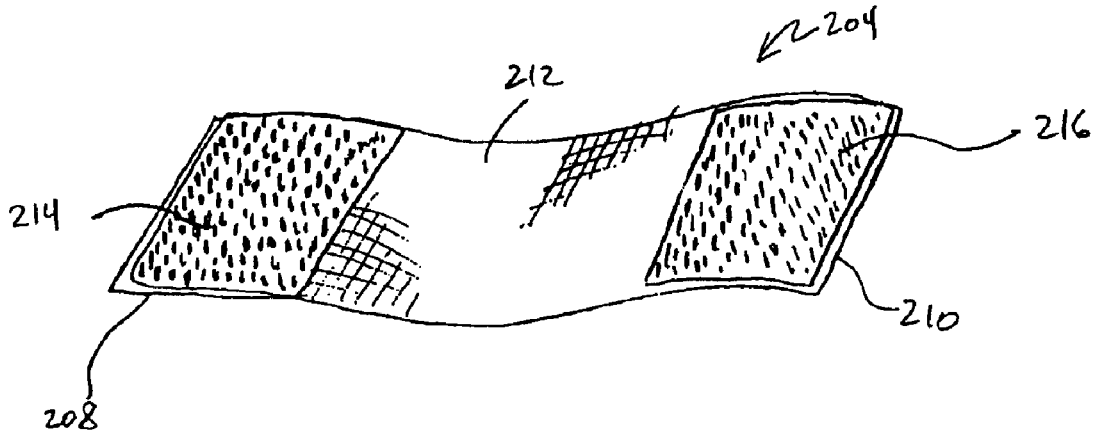

FIG. 20 is a perspective view of a first strap of the adjustable top restraint.

Figure 21:
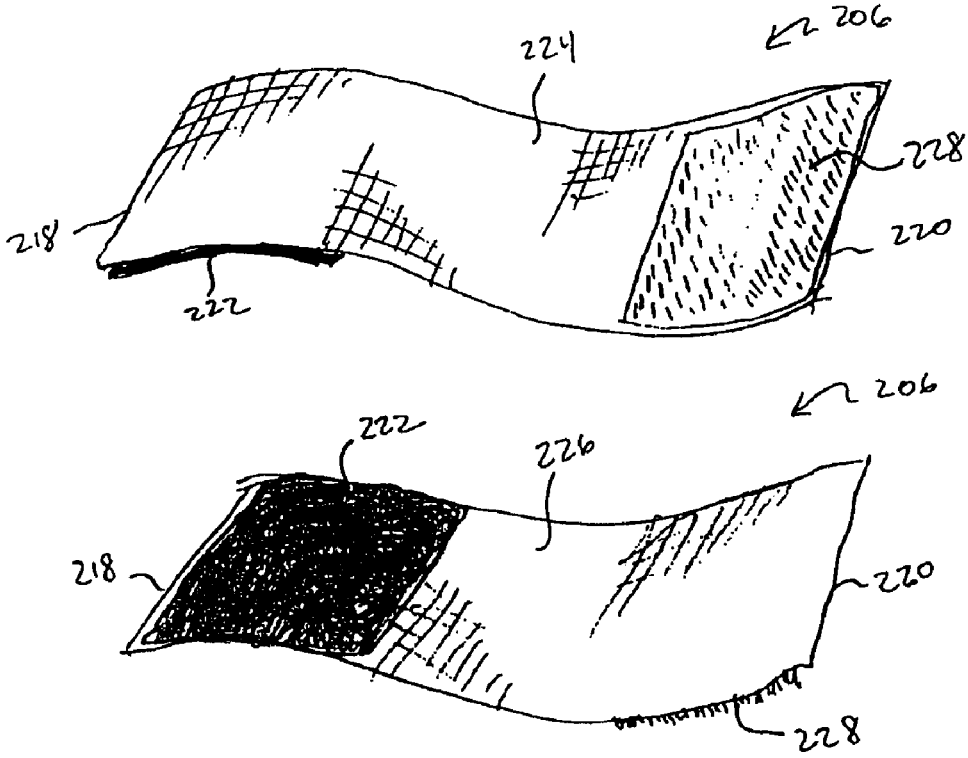

FIG. 21 is a perspective view of a second strap of the adjustable top restraint.

Figure 22:
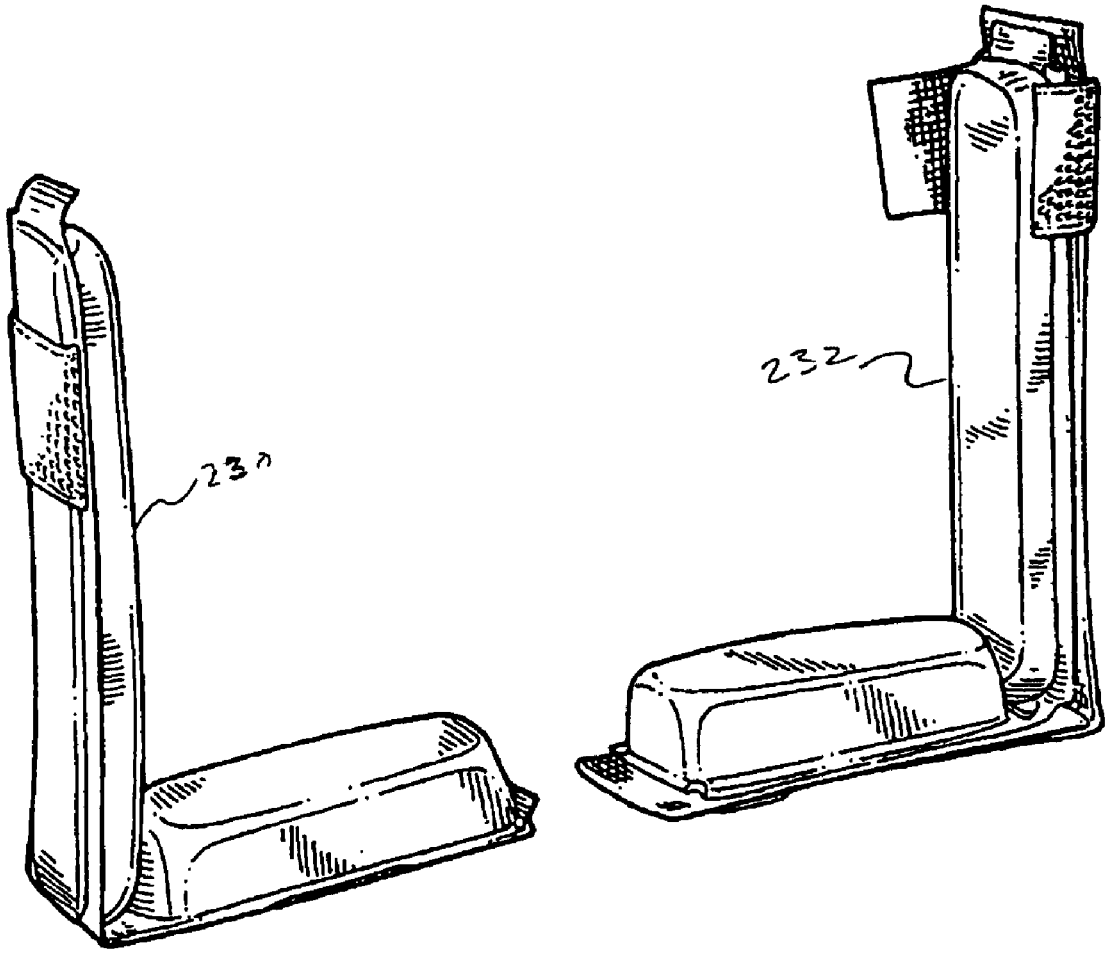

FIG. 22 is a perspective view of first and second user-positionable, impact resistant, adjustable cushions for supporting a portable computer device within a central interior storage compartment of the multi-function travel case.

Figure 23:
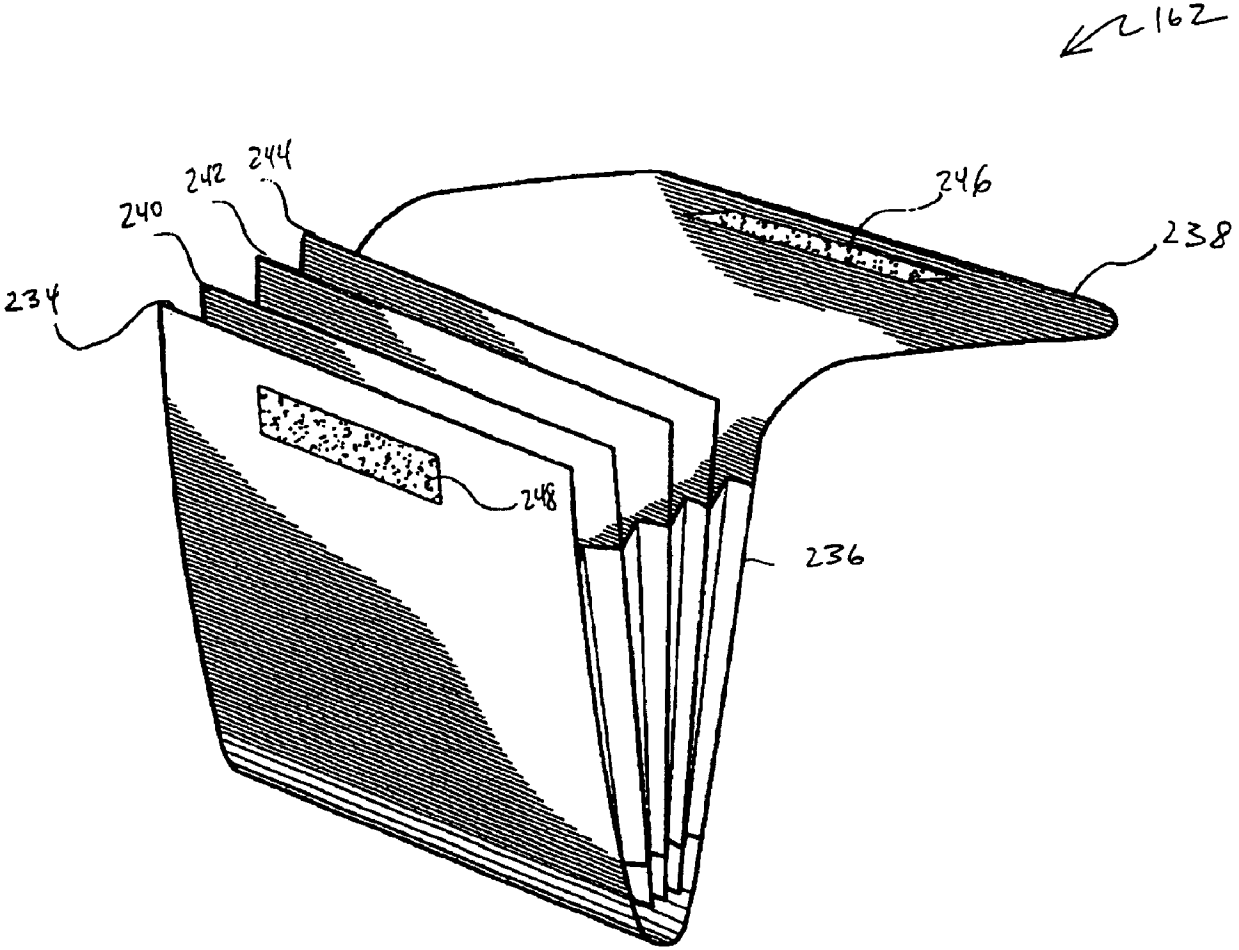

FIG. 23 is a perspective view of a removable file folder that may be stored in a rear interior storage compartment of the multi-function travel case.

Figure 24:
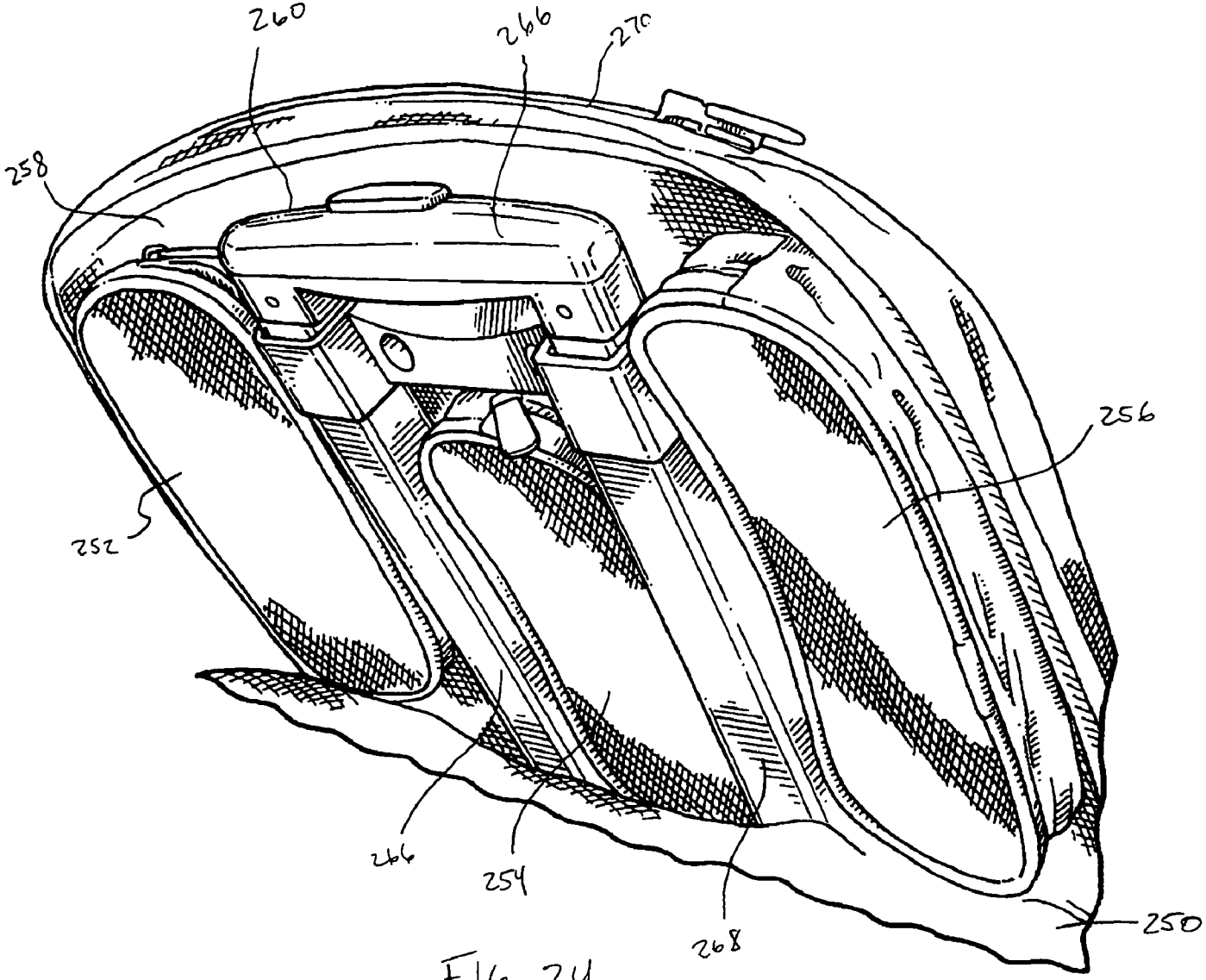

FIG. 24 is a broken perspective view of the multi-function travel case illustrating an opened rear interior storage compartment thereof having removable zipper mesh pockets and a telescoping roller handle stored therein.

Figure 25:
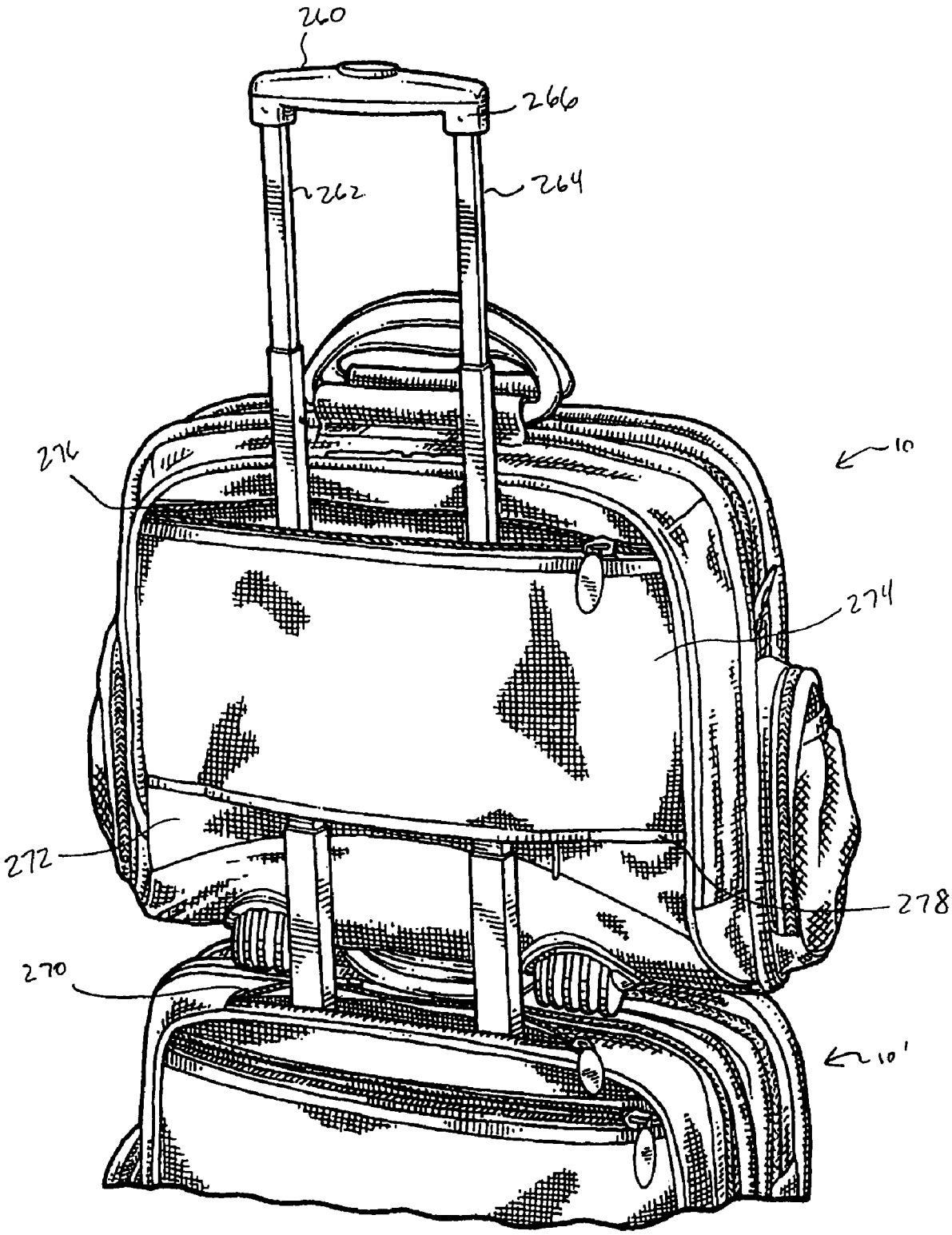

FIG. 25 is a back view of first and second multi-function travel cases, the first multi-function travel case having an opened back panel adapted for secure stacking on the second multi-function travel case.

Figure 26:
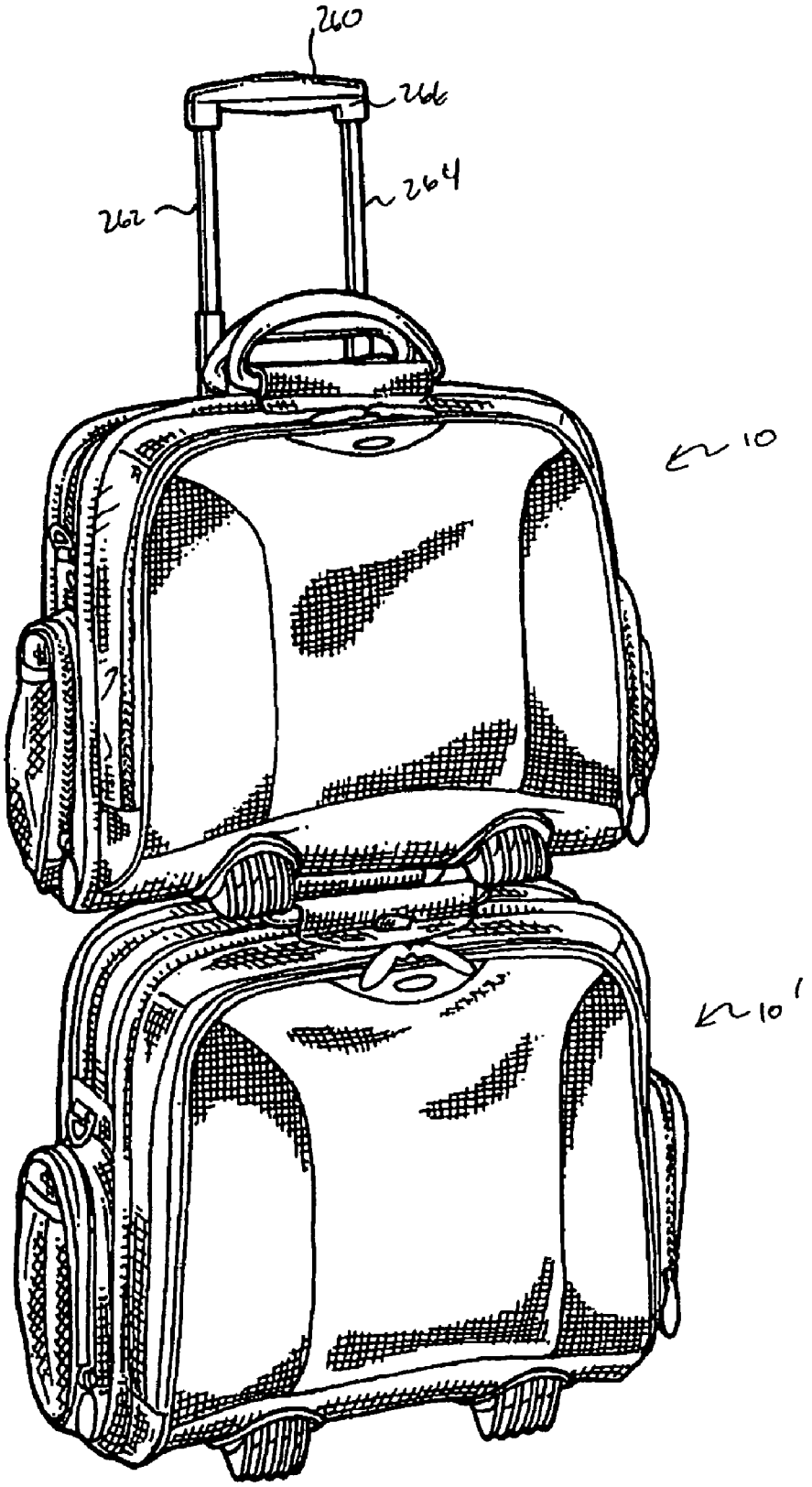

FIG. 26 is a front view of the first and second multi-function travel cases in a secure stacking configuration.

DETAILED DESCRIPTION OF THE INVENTION

With reference to the drawings, a travel case 10 that includes a plurality of features for facilitating ease of travel is provided. With specific reference to FIGS. 1, 2 and 15, the travel case 10 includes a first overlapping front pocket 12, a second overlapping front pocket 14, a side pocket 24, a first side storage compartment 16, a second side storage compartment 18, a front interior storage compartment 20, a center interior storage compartment 22, a rear interior storage compartment 23, a retractable document sleeve 30, a handle having first and second handle portions 26 and 28, and four anti-tip feet portions 32, 34, 36, and 38.

Figure 3:
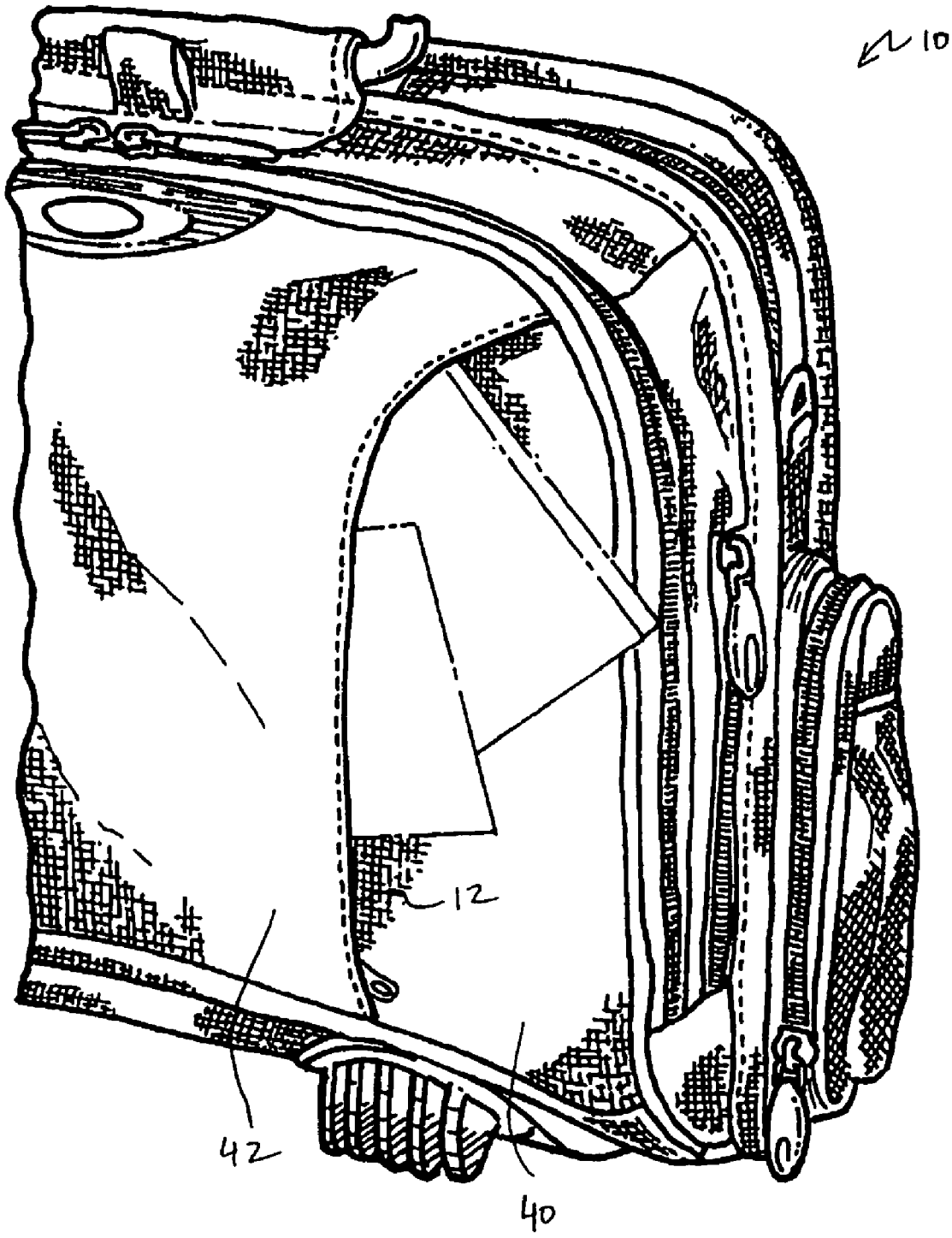
FIG. 3 is a broken front perspective view of the multi-function travel case illustrating a first of two overlapping front pockets thereof.
Figure 4:
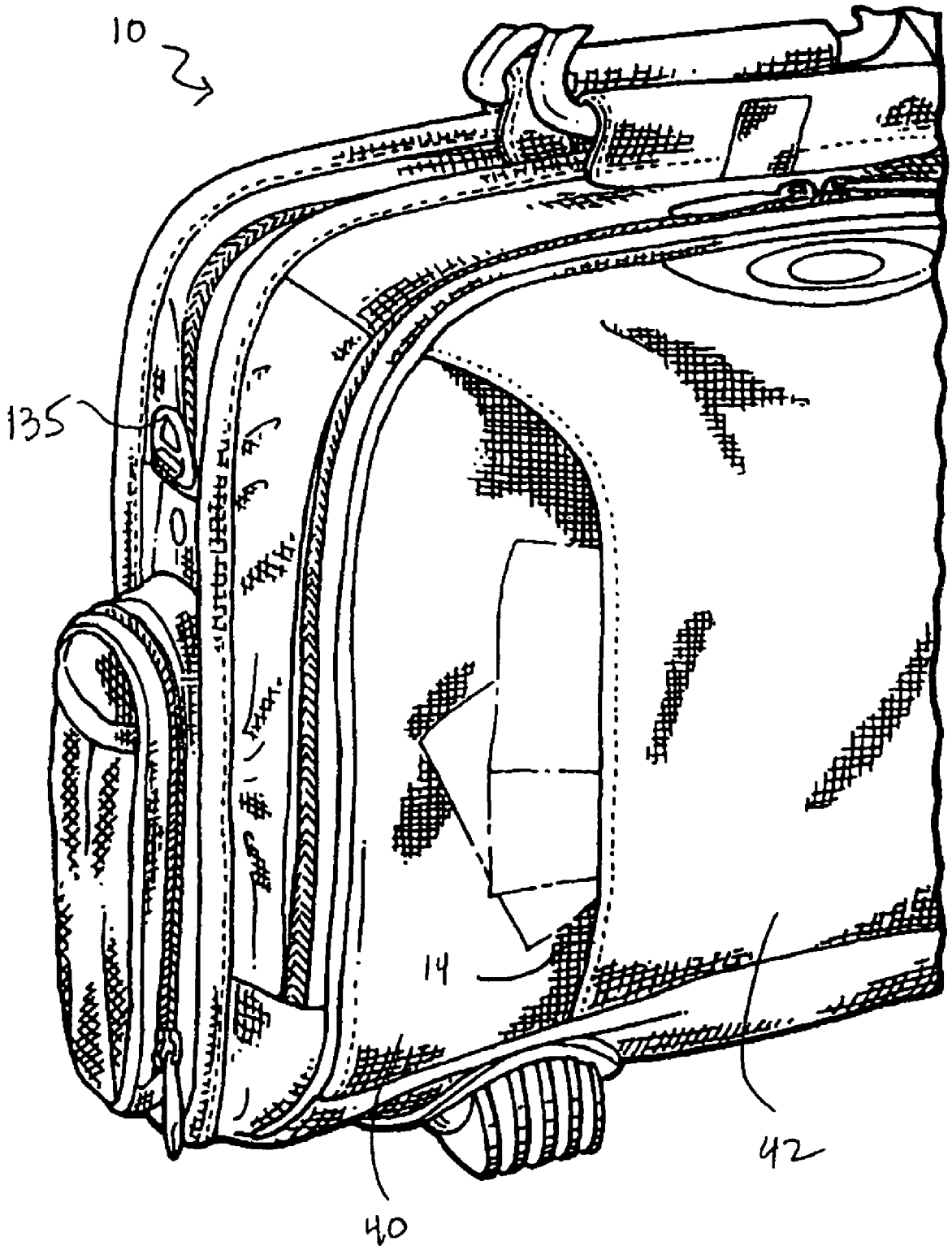
FIG. 4 is a broken front perspective view of the multi-function travel case illustrating the second of two overlapping front pockets thereof.

As shown in FIGS. 3 and 4, first and second overlapping pockets 12 and 14 are defined in an area between a front side 40 of travel case 10 and a front panel 42 affixed thereto. In particular, first overlapping pocket 12 is defined in an area between front side 40 of travel case 10 and a back wall of second overlapping pocket 14, and second overlapping pocket 12 is defined in an area between a front wall of first overlapping pocket 12 and front panel 42. The opening of each of first and second overlapping pockets 12 and 14 can be sealed by way of a zipper, slider and pull configuration (not shown). These zippered openings are concealed beneath front panel 42. First and second overlapping pockets provide two areas for the easy storage of documents, such as tickets and receipts, during travel. Because they are not readily visible, the concealed pockets 12 and 14 provide a means for safeguarding any contents stored therein.

Figure 5:
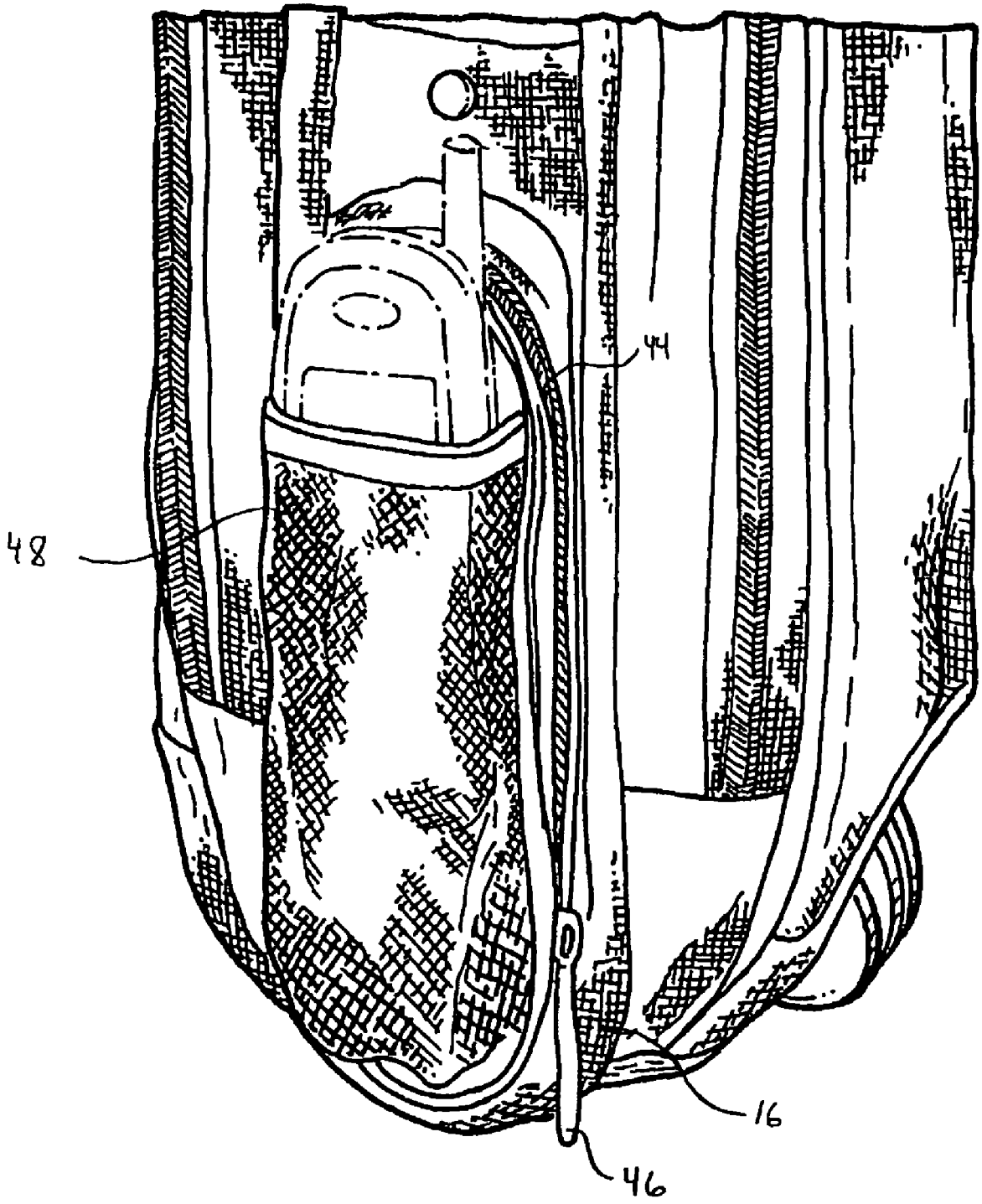
FIG. 5 is a broken side perspective view of the multi-function travel case showing a first side storage compartment thereof having an exterior pocket.

FIG. 5 shows first side storage compartment 16 of travel case 10, which is opened and closed by way of a zipper 44 and slider/pull 46, and an exterior pocket 48 affixed thereto. Exterior pocket 48 provides, in part, for convenient storage and access of objects that may be needed during travel. Exterior pocket 48 preferably comprises an elastic mesh material, such as elastic nylon, that can expand to encompass objects of a variety of sizes, such as a cellular telephone, compact umbrella, personal digital assistant (PDA), or the like.

Figure 6:
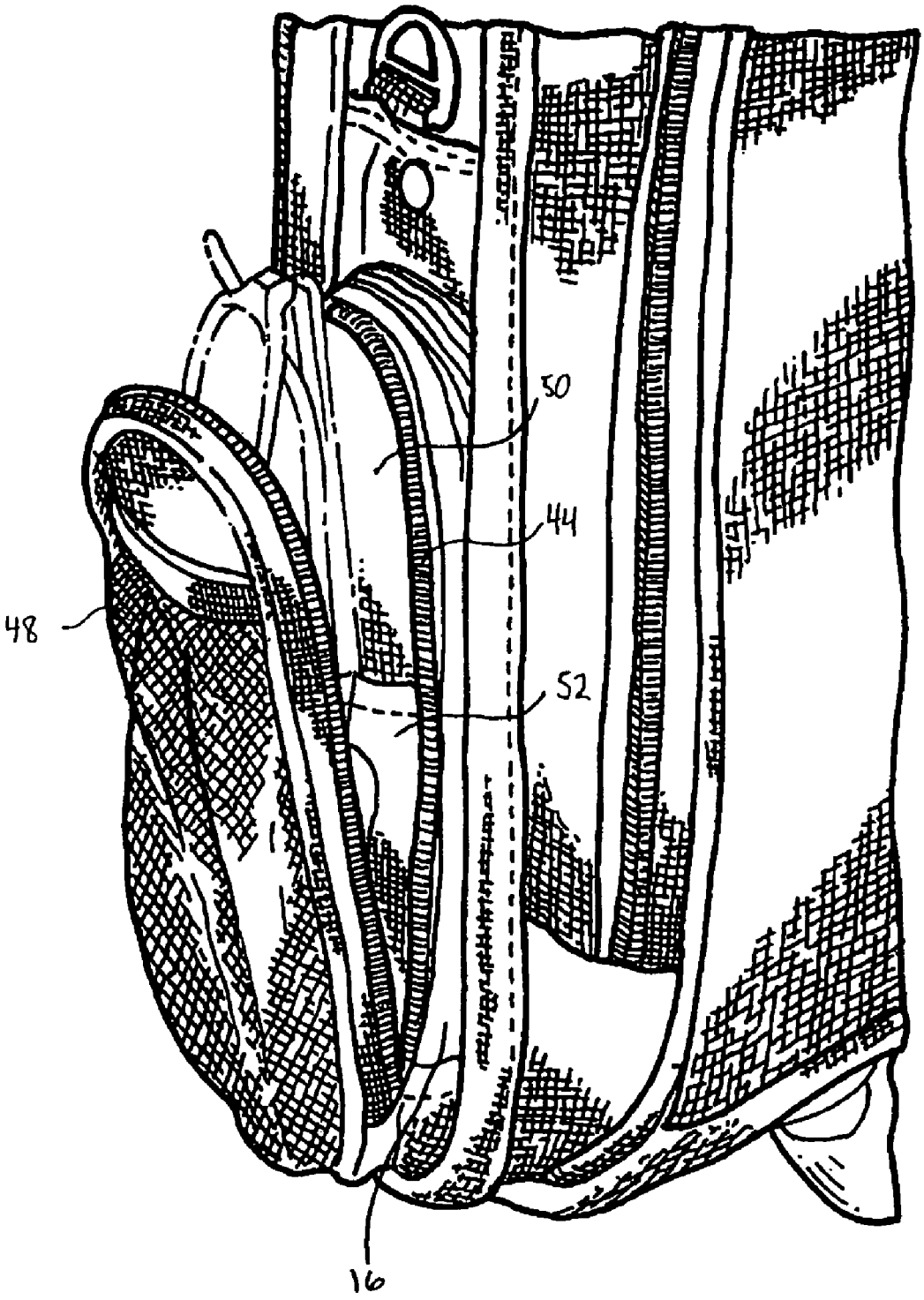

FIG. 6 illustrates first side storage compartment 16 in an opened position to reveal an interior area 50 which is defined by a front and back wall adjoined, in part, by expandable triangular gussets 52. The interior front and back walls are preferably lined with a soft material, such as nyflex, to protect sunglasses, eyeglasses, or other objects that may be prone to scratching. The interior of first side storage compartment 16 may also include an interior pocket (not shown) affixed to the back wall, the interior pocket preferably comprising an elastic mesh material, such as elastic nylon.

Figure 7:
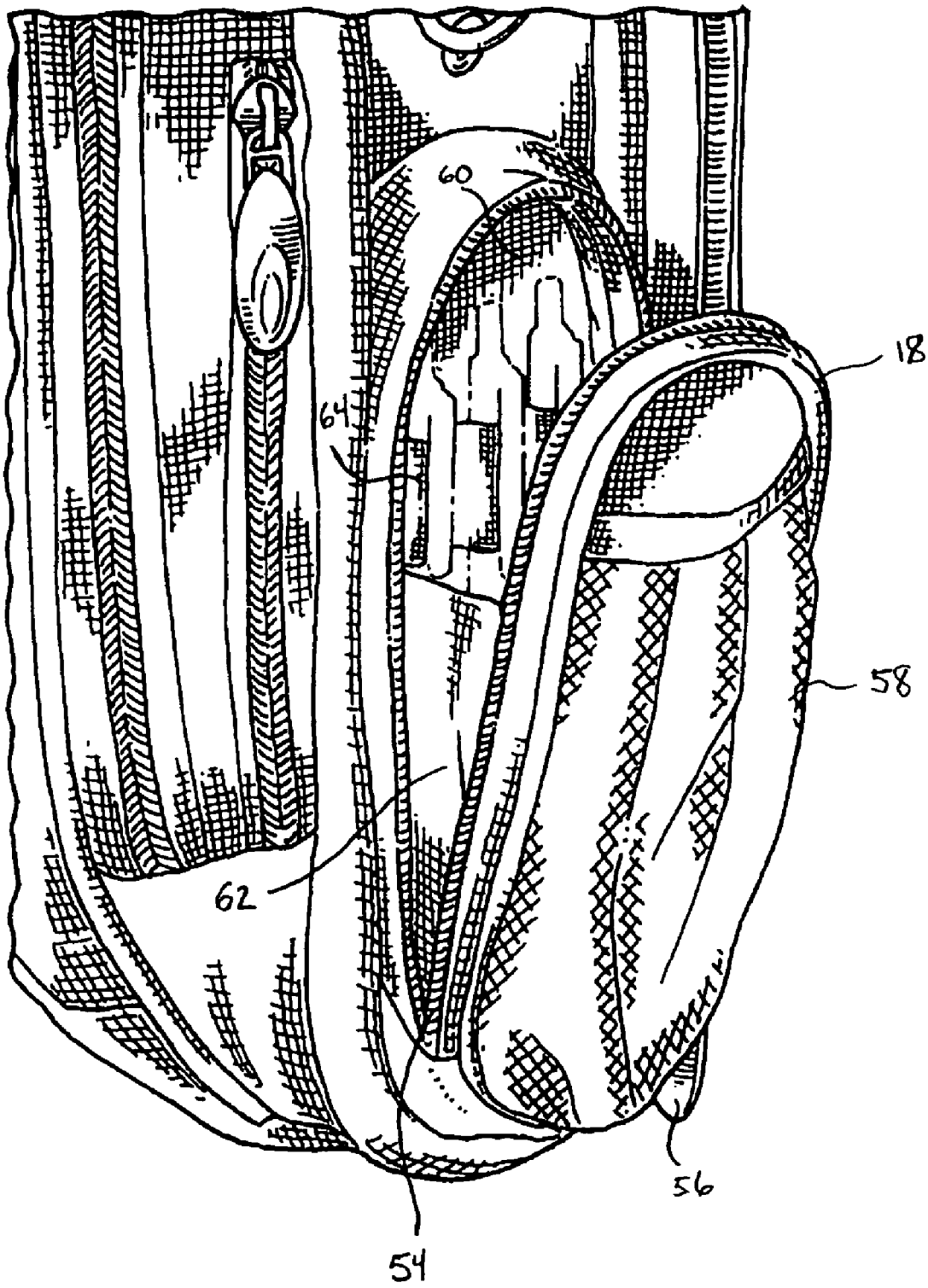
FIG. 7 is a broken side perspective view of the multi-function travel case showing a second side storage compartment thereof having an exterior pocket and opened to reveal an interior area adapted, in part, for the storage of writing implements.

FIG. 7 illustrates second side storage compartment 18 of travel case 10 in an opened position. Second side storage compartment 18 is opened and closed by means of a zipper 54 and slider/pull 56, and has an interior area 60 defined by a front and back wall joined, in part, by expandable triangular gussets 62. The interior back wall of compartment 18 includes a writing implement holder 64 for holding pens, pencils and the like. Writing implement holder 64 preferably comprises an elastic fabric, such as an elastic nylon fabric, which is affixed in a folded manner to the interior back wall of compartment 18. The interior of second side storage compartment 18 may also include one or more interior pockets (not shown) affixed to the front and/or back wall, each of which preferably comprises an elastic mesh material, such as elastic nylon.

As shown in FIG. 7, second side storage compartment 18 also has an exterior pocket 58 affixed thereto, which, like exterior pocket 48, provides, in part, convenient storage of and access to objects that may be needed during travel. Exterior pocket 58 preferably comprises an elastic mesh material, such as elastic nylon, that can expand to encompass objects of a variety of sizes.

Figure 8:
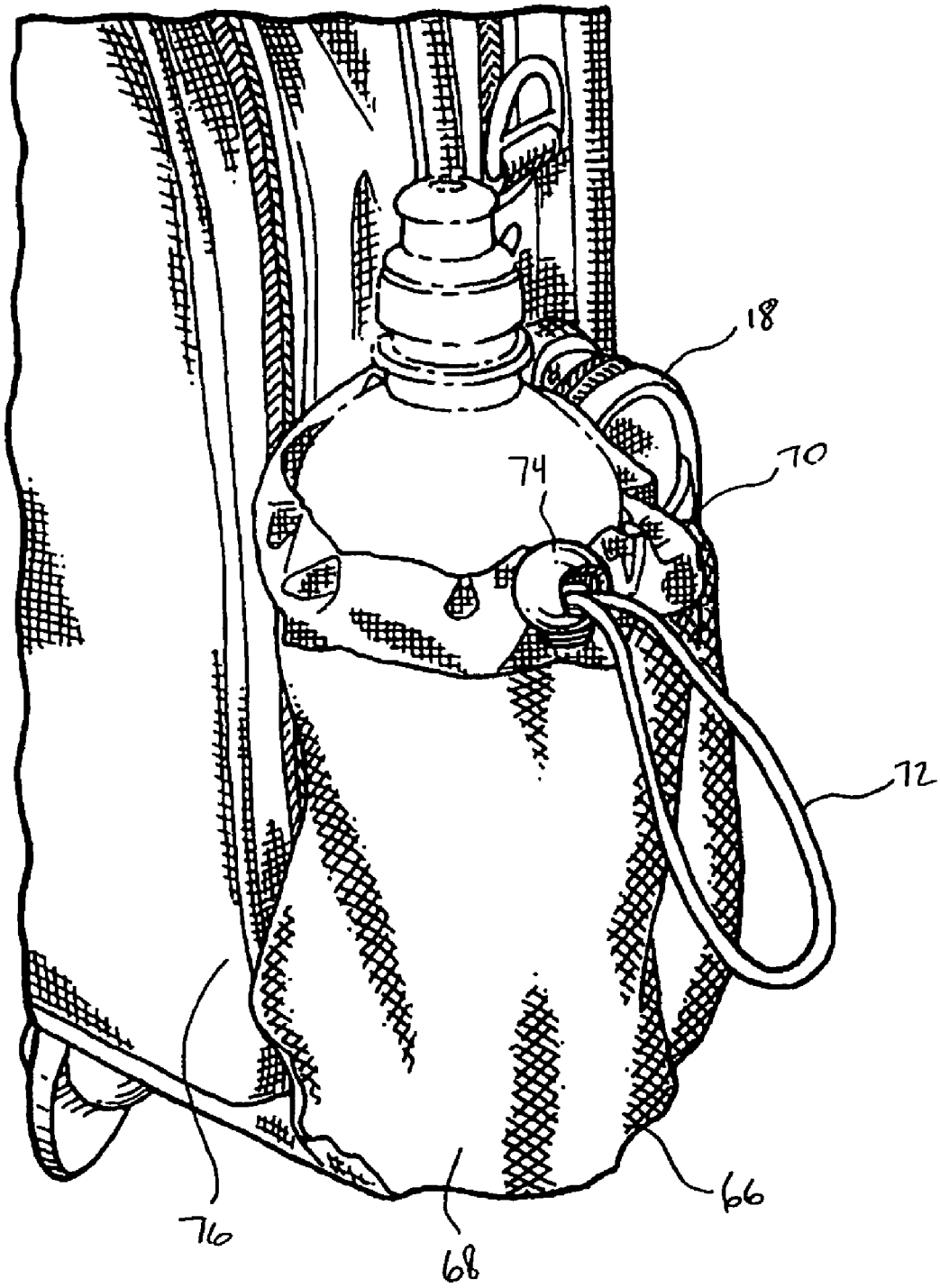
FIG. 8 is a broken side perspective view of the multi-function travel case showing a retractable bottle holder extended from a side pocket thereof.

FIG. 8 shows a retractable bottle holder 66, which is accessible via zippered side pocket 24 of travel case 10. Retractable bottle holder 66 is adapted to securely store a bottle, such as a water or soda bottle, in a manner that prevents spilling but allows for ease of access to the bottle during travel. Retractable bottle holder 66 is affixed to an inner wall of side pocket 24, which is defined within a triangular gusset 156 (see FIG. 15) of front interior storage compartment 20. Thus, retractable bottle holder 66 may be conveniently hidden inside zippered side pocket 24 when not in use.

Retractable bottle holder 66 comprises a mesh bag 68 having a draw cord closure 70 affixed to a top portion thereof. Draw cord closure 70 encloses a circular draw cord 72, a portion of which emerges from an external opening thereof. The portion of circular draw cord 72 that is external to draw cord closure 70 is encompassed by draw cord lock 74. Draw cord lock 74 is slidably adjustable to shorten or lengthen the portion of circular draw cord 72 that is internal to draw cord closure 70, thereby tightening or loosening draw cord closure 70 respectively. For example, draw cord closure 70 can be loosened to insert a bottle into retractable bottle holder 66, and then tightened around the neck of the bottle to ensure that the bottle does not slip out of holder 66 during travel. In an embodiment, draw cord 72 comprises an elastic cord, and retractable bottle holder 66 is large enough to accommodate a 120 mm bottle.

In an embodiment, retractable bottle holder 66 is affixed to an inner wall of side pocket 24 by a seam that runs along substantially the entire length of holder 66 from top to bottom and parallel to the vertical opening of side pocket 24. By affixing retractable bottle holder 66 in this manner, swaying motion of the holder in the vertical direction is impeded. Horizontal motion of holder 66 is likewise impeded by the juxtaposition of side storage compartment 18 and front corner 76 of travel case 10. Consequently, swinging of a bottle that is placed inside retractable bottle holder 66 during travel is minimized.

Figure 9:
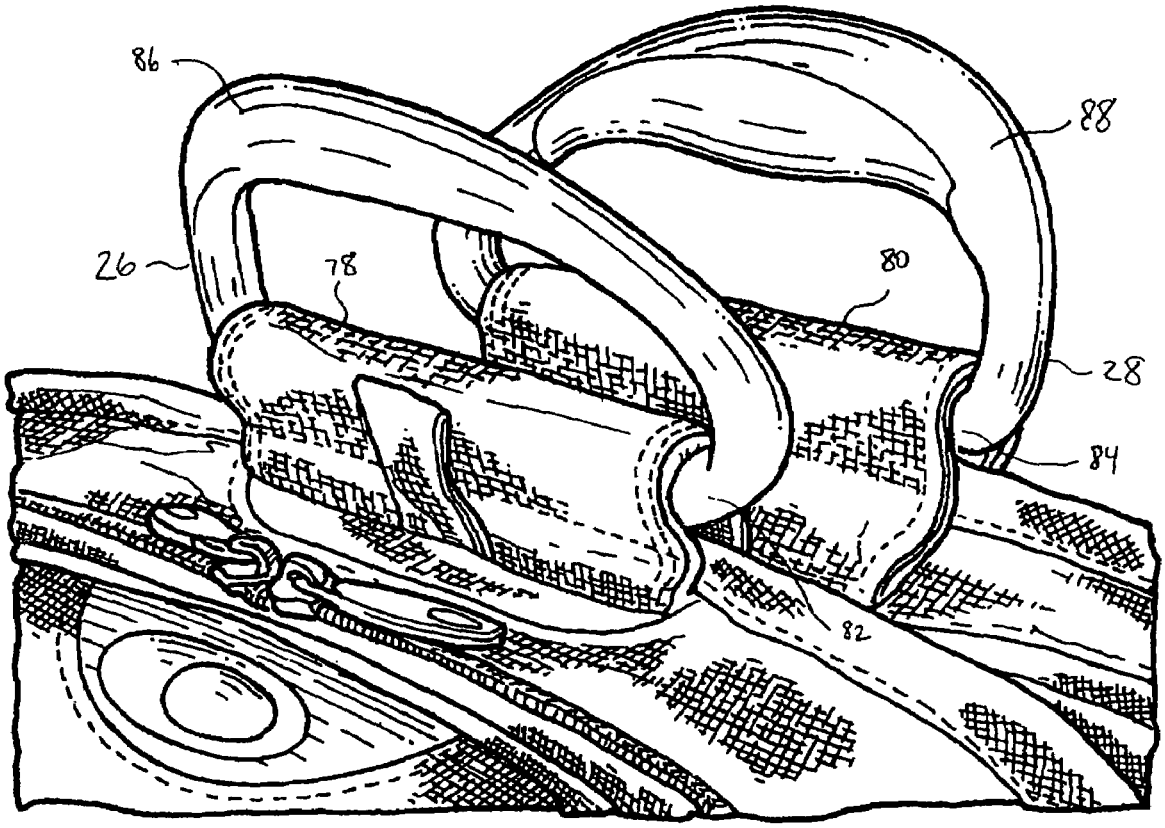
FIG. 9 is a broken top perspective view of the multi-function travel case showing a handle thereof having first and second handle portions, wherein the first and second handle portions are in a disengaged position.
Figure 10:
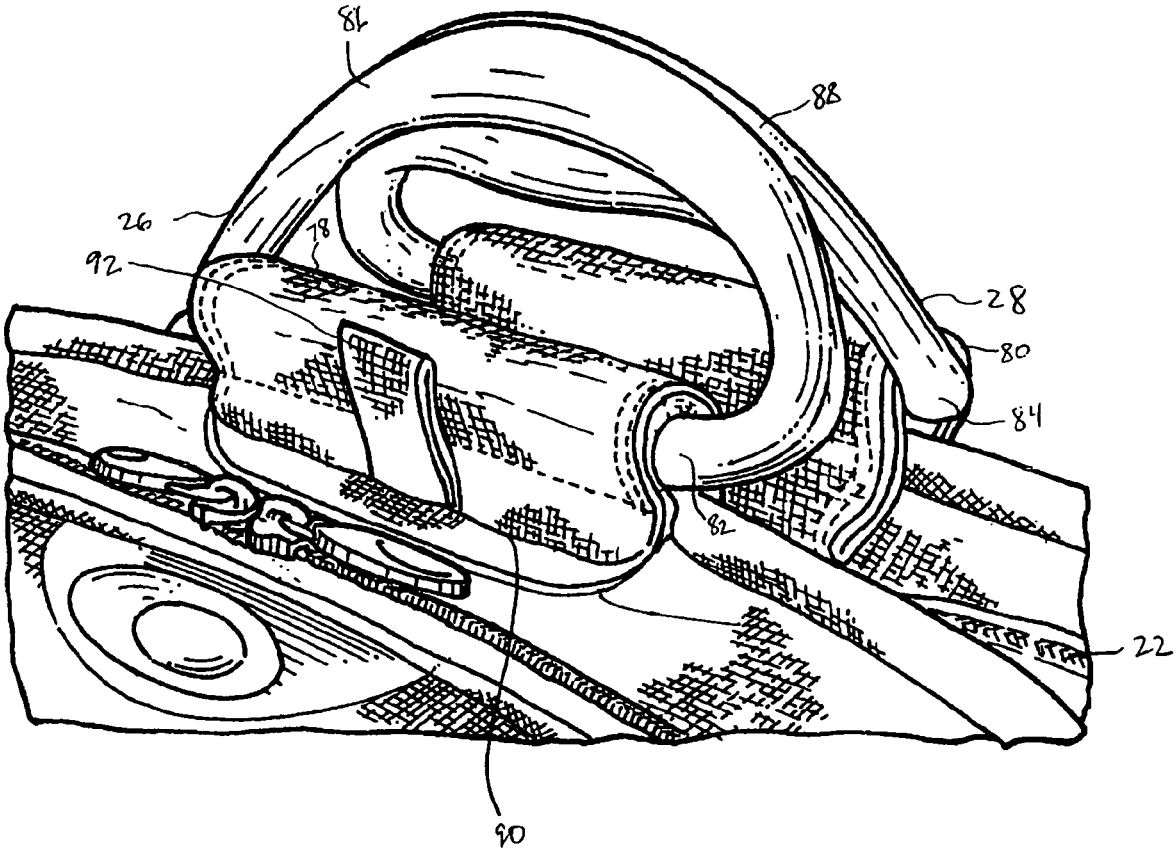
FIG. 10 is a broken top perspective view of the multi-function travel case showing the first and second handle portions in an engaged position.

FIGS. 9 and 10 show the ergonomically designed handle of travel case 10 comprising first handle portion 26 and second handle portion 28, which are preferably made of rubber. Each of first and second handle portions 26 and 28 has an arcuate segment 86 and 88, respectively, mounted for rotation relative to the top of travel case 10. In particular, first handle portion 26 has arcuate segment 86 and a straight segment 82 joined to form a first loop. Second handle portion 28 has arcuate segment 88 and a straight segment 84 joined to form a second loop. The straight segments 82 and 84 are respectively mounted in first and second sleeves 78 and 80, which are affixed to the top of travel case 10. This configuration allows first and second handle portions 26 and 28 to rotate or pivot about parallel axes between a disengaged position in which the handle portions are separated from one another, as shown in FIG. 9, and an engaged upstanding position wherein the handle portions are in abutment, as shown in FIG. 10.

Arcuate segments 86 and 88 include inner surfaces, respectively, configured to automatically mate when the segments are rotated to the engaged position, the inner surface of first handle portion 26 being configured as a protuberance and the inner surface of second handle portion 28 being configured as a cavity for receiving the protuberance. This design aspect of pivotable handle portions 26 and 28 causes the handle of travel case 10 to tend to remain in an upstanding, engaged position when the carrying case is supported in an upright position on a support surface. Also, an outer surface of first handle portion 26 is completed by an outer surface of second handle portion 28 in the engaged position, so that no seams or other discontinuous surfaces are presented along a bottom surface of the handle that bears against the hand when the carrying case is picked up and carried via the handle. Further details concerning the ergonomic design of first and second handle portions 26 and 28 and benefits accruing thereto are found in commonly owned U.S. Pat. No. 6,390,297 to Hollingsworth, issued May 21, 2002, and entitled "Carrying Case for Portable Computer," the entirety of which is incorporated by reference as if fully set forth herein.

Figure 11:
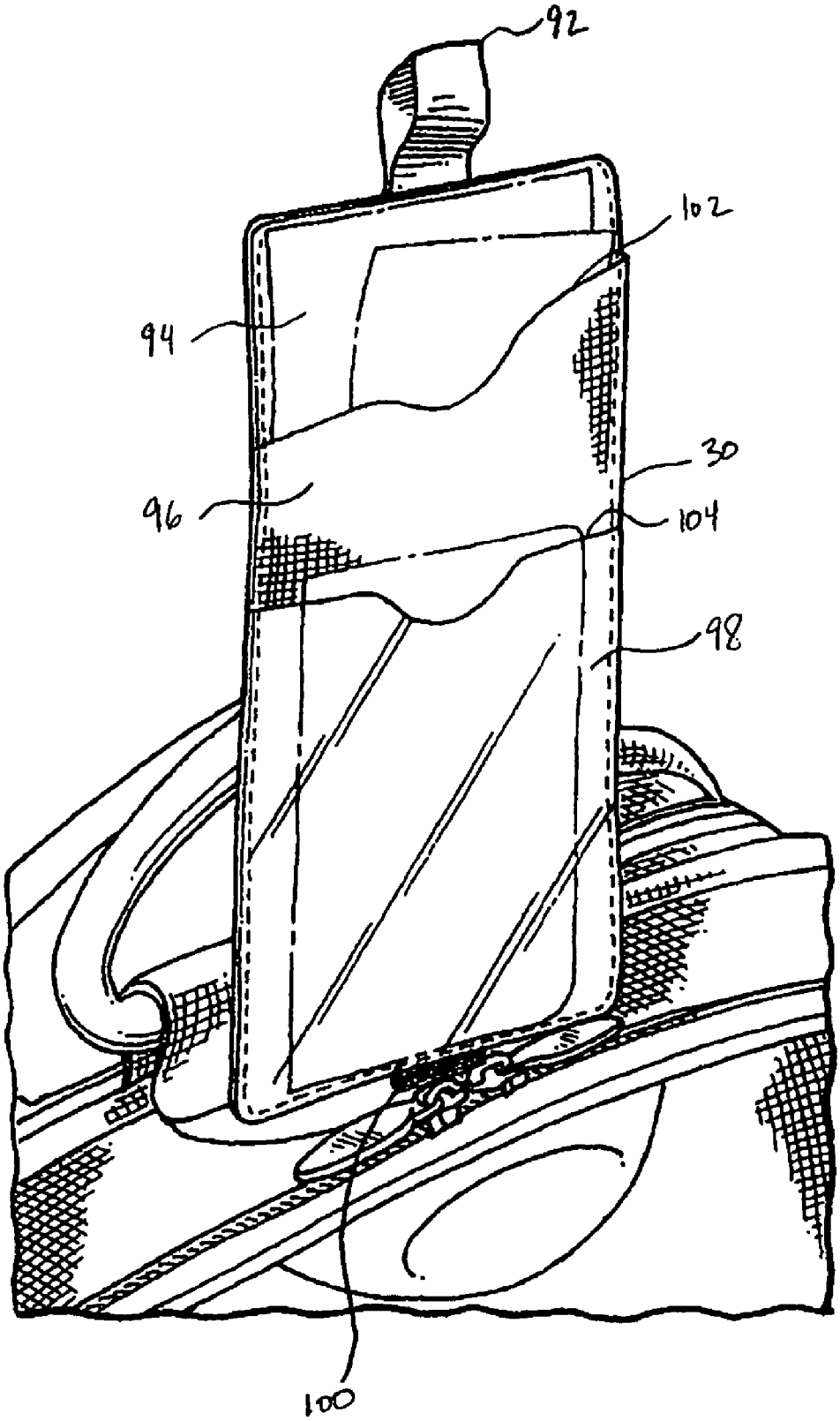
FIG. 11 is a broken top perspective view of the multi-function travel case showing a retractable document sleeve extended from a top pocket thereof.

FIGS. 10 and 11 further illustrate the retractable document sleeve 30 of travel case 10. Retractable document sleeve 30 provides a means for storing important travel-related documents, such as airline tickets, passports, or other identification information, in a manner that allows for quick, secure and easy access, viewing and storage of same during travel.

As shown in FIG. 10, in a retracted position, retractable document sleeve 30 is largely concealed from view within a top pocket 90 of travel case 10, with the exception of a pull tab portion 92. Top pocket 90 is preferably located immediately adjacent to an outside seam of first handle sleeve 78 so that it is somewhat concealed by the sleeve. By concealing the retractable document sleeve 30 in this fashion, a means is provided for safeguarding any contents stored therein.

FIG. 11 shows retractable document sleeve 30 in an extended position, the sleeve including pull tab 92, a sleeve body 94, a first panel 96, a second panel 98, and a strip of elastic webbing 100. Pull tab 92 comprises a loop of fabric which is affixed to a top portion of back wall 94 of the sleeve. By grasping and pulling upward on pull tab 92, retractable document sleeve 30 may be extended from hidden top pocket 90.

With further reference to FIG. 11, a bottom and two side portions of first panel 96 are affixed to sleeve body 94, thereby defining a first document sleeve pocket 102 for the storage of documents therein. First document sleeve pocket 102 is preferably deep enough to store a standard airline ticket therein. First panel 96 is also preferably shorter than sleeve body 94, thereby creating an exposed area by which documents stored in first document sleeve pocket 102 can be handled and partially viewed.

A bottom and two side portions of second panel 98 are affixed to first panel 96, thereby defining a second document sleeve pocket 104 for the storage of documents therein. Second panel 98 is preferably shorter than first panel 98, thereby creating an exposed area by which documents stored in second document sleeve pocket 104 can be handled and partially viewed. Second panel 98 also preferably consists of a transparent plastic material so that documents stored within second document sleeve pocket 104 can be viewed without being removed from the sleeve. This feature permits documents that must be frequently presented and reviewed during air travel, such as photo identification, to be reviewed without being removed from the sleeve.

A strip of elastic webbing 100 is affixed to a bottom portion of sleeve body 94 and to a bottom interior portion of top pocket 90, thereby flexibly securing retractable document sleeve 30 to the bottom of top pocket 90. Because elastic webbing is used to secure document sleeve 30 to the bottom of top pocket 90, when pull tab 92 is released by a user, document sleeve 30 will automatically retract into the interior of top pocket 90. This feature permits documents stored in the sleeve to be viewed and then easily returned to the interior of top pocket 90 with minimal user action. It also allows those important documents to be stored securely and out of view.

Figure 12B:
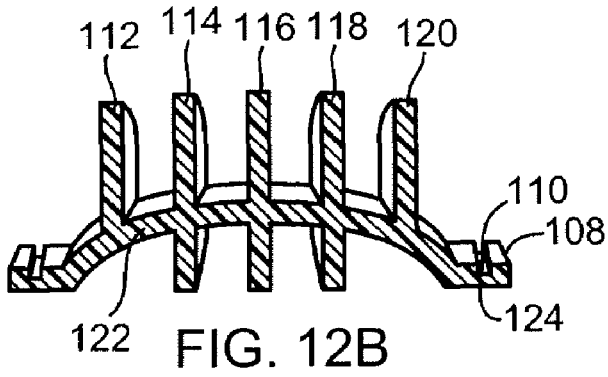
Figure 12A:
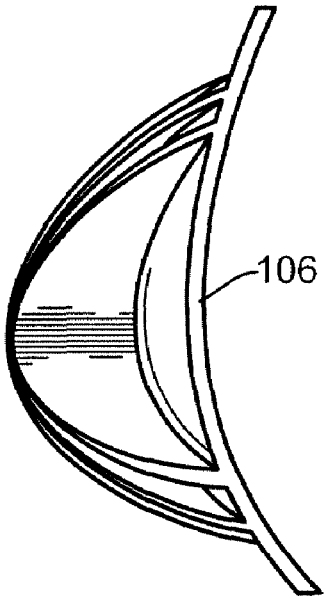
Figure 12C:
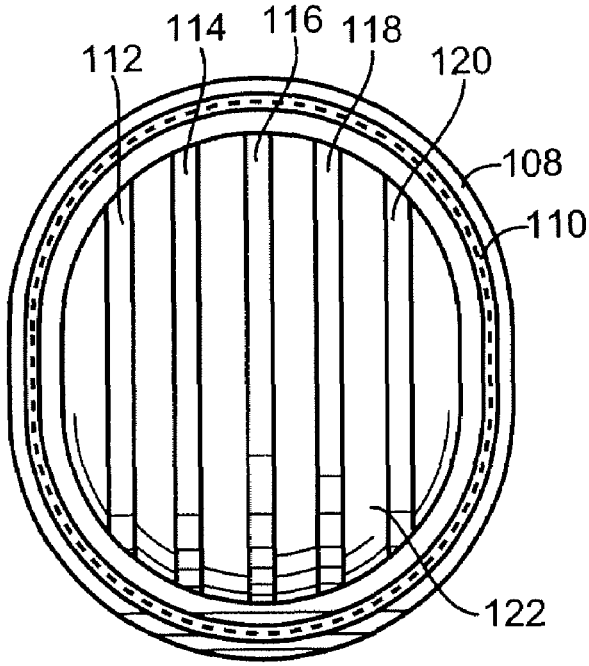
Figure 12D:
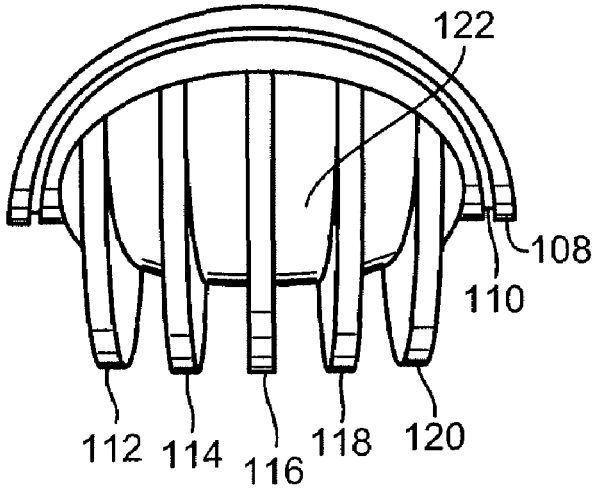

With respect to FIGS. 12A, 12B, 12C, and 12D, an anti-tip foot 32, 34, 36 or 38 of travel case 10 is illustrated. The anti-tip foot includes a base portion 106 and a plurality of fins 112, 114, 116, 118 and 120. Base portion 106 includes an external ring 108 and an arched central portion 122. An inside 124 of external ring 108 contacts and is affixed to the body of travel case 10. As shown in FIG. 12B, a channel 110 is defined in the outside of external ring 108. As also shown in FIG. 12B, fins 112 and 120 extend outward from arched central portion 122, while fins 114, 116 and 118 extend both outward and inward from central portion 122 relative to the body of travel case 10.

Figure 1:
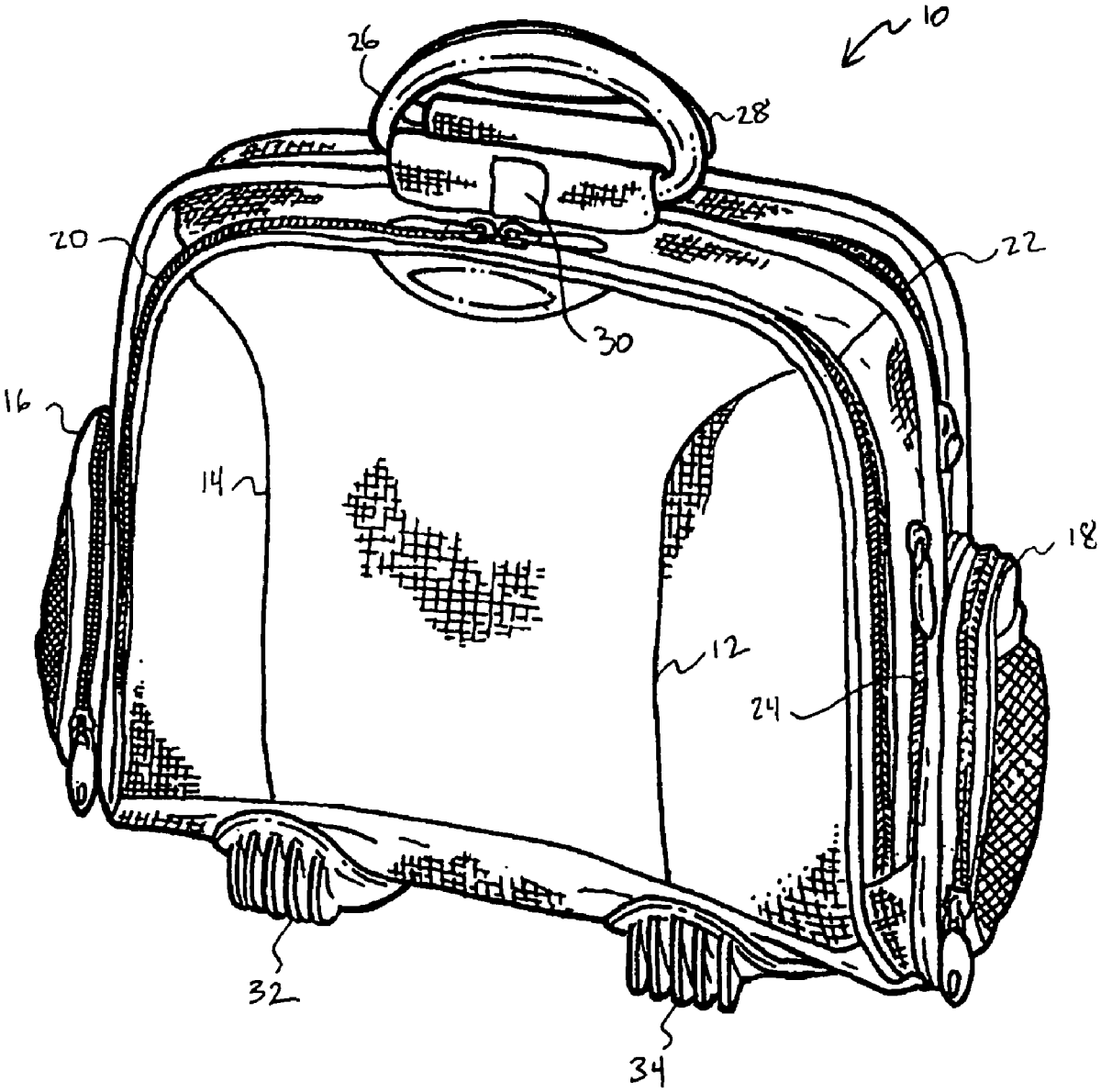
FIG. 1 is a front perspective view of a multi-function travel case in accordance with an embodiment of the present invention.
Figure 2:
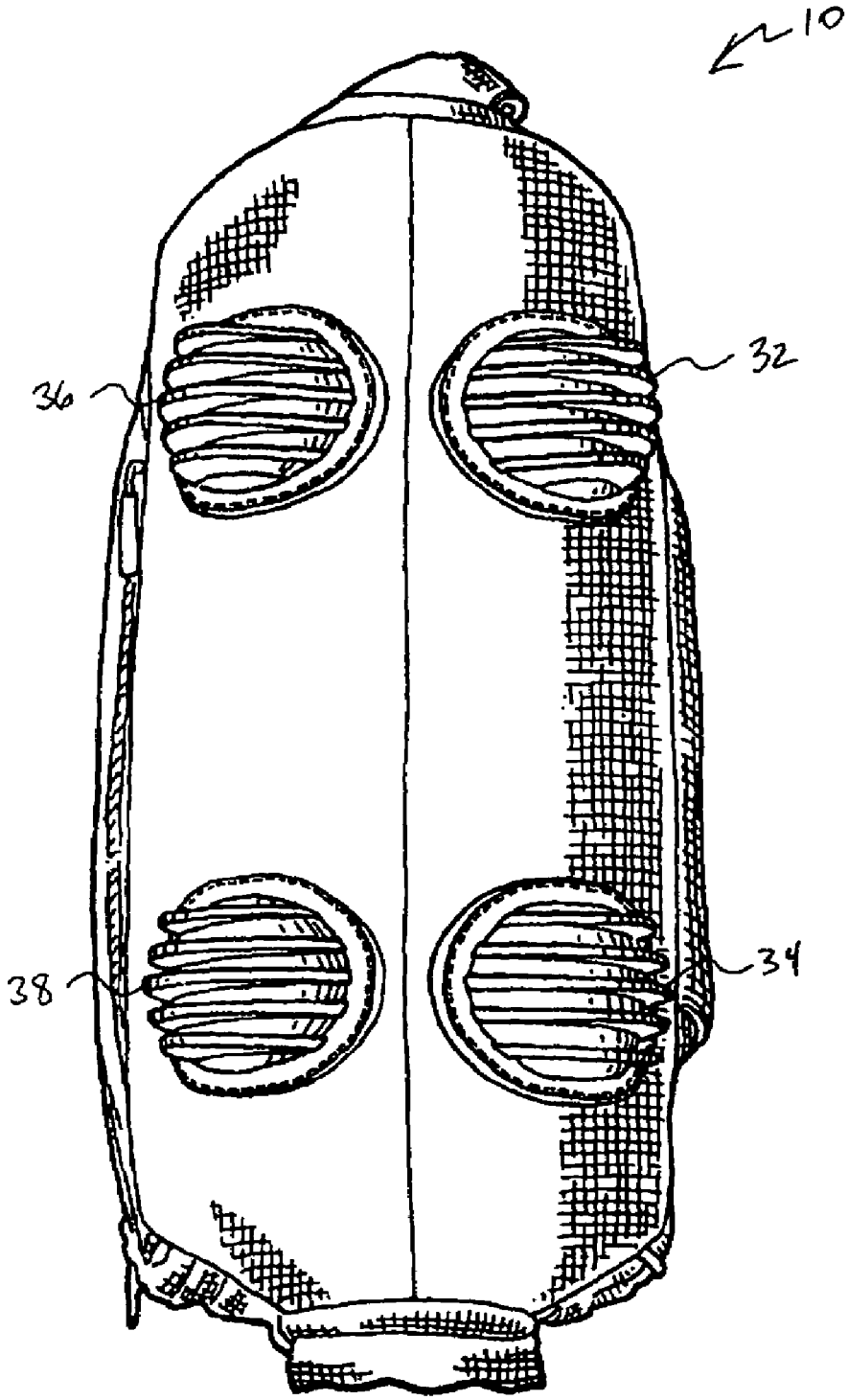
FIG. 2 is a bottom view of the multi-function travel case.

Each anti-tip foot is affixed to the bottom of travel case 10 at one of four positions as shown in FIGS. 1 and 2. Each anti-tip foot preferably comprises a single unit of molded heavy-duty plastic. The shape and position of the anti-tip feet provide reliable support for travel case 10 when placed in an upright position on a support surface, and reduce the chances that travel case 10 will fall over. The use of plastic fins provides for better grip of the support surface, and also serves to reduce the overall weight of each anti-tip foot.

FIG. 13 illustrates a first of two shoulder strap retainers 126 which are attached to either side of travel case 10 and permit a detachable shoulder strap to be coupled thereto. The other shoulder strap retainer 135 is depicted in FIG. 4. As shown in FIG. 13, each shoulder strap retainer includes a metal connector portion 128, to which a detachable shoulder strap 132 may be connected, and a connector sleeve 130, which is affixed to a side of travel case 10. A straight segment of metal connector 128 is mounted in connector sleeve 80, allowing metal connector 128 to rotate about the segment axis.

FIG. 14 illustrates a means for securing central interior storage compartment 22 of travel bag 10, which is adapted for the storage of a portable computing device, such as a laptop computer. The securing means include first and second zipper sliders 136 and 138 that can be engaged in a cooperative mating position for receiving a locking apparatus 148.

In particular, with reference to FIG. 14, first and second zipper sliders 136 and 138 are shown for sealing and unsealing a zipper 134 that provides access to central interior storage compartment 22 of travel bag 10. Each zipper slider 136 and 138 can be moved to open or close zipper 134 by means of an attached first and second zipper pull 144 and 146, respectively. First zipper slider 136 includes a first mating ring portion 140 that extends upward from the portion of zipper slider 136 that mates with zipper 134. Second zipper slider 138 includes a second mating ring portion 142 that extends upward from the portion of zipper slider 138 that mates with zipper 134. When the two sliders 136 and 138 are brought immediately adjacent to one another as shown in FIG. 14, the rings of first and second mating ring portions 142 and 144 are brought into alignment such that a band 150 of a locking apparatus 148 can be passed through both aligned ring portions 142 and 144, thereby allowing zipper 134 to be secured in a closed position. Locking apparatus 148 may comprise, for example, a Targus DEFCON TL Notebook Computer Travel Lock, sold by Targus Inc. of Anaheim, Calif. However, the invention is not limited to that example.

FIG. 15 illustrates travel case 10 with front interior storage compartment 20, center interior storage compartment 22, and rear interior storage compartment 23 all in an open position.

With reference to FIGS. 15 and 16, front interior storage compartment 20 comprises a front wall portion 152 and a rear wall portion 154 adjoined, in part, by expandable triangular gussets 156 and 158. Front wall portion 152 includes a first mesh pocket 164, a second mesh pocket 166, and integrated CD/DVD pockets 168. First and second mesh pockets 164 and 166 each preferably comprise an elastic nylon mesh material and are therefore capable of accommodating objects of various sizes, such as portable computer components and accessories, personal digital assistants (PDAs), and the like. Integrated CD/DVD pockets 168 are preferably formed from overlaid flat panels of a soft non-woven material that will minimize scratching of any optical media stored therein.

With reference to FIGS. 16, 17 and 18, rear wall portion 154 includes first and second large pockets 170 and 172, first and second storage media pockets 174 and 176, a key holder 178 attached to a fabric loop 180, a writing implement holder 182, a retractable light, and space for housing a removable accessory pouch 160.

First and second large pockets 170 and 172 are affixed to rear wall portion 154 and are suitable for storing objects such as portable computer components and accessories, including removable storage drives and batteries, as well PDAs, pocket PCs, calculators, and the like. First storage media pocket 174 is affixed to the outside of first large pocket 170 and second storage media pocket 176 is affixed to the outside of second large pocket 172. First and second storage media pockets 174 and 176 are well-suited, in part, for the storage of various types of storage media that may be used with a portable computing device, including floppy disks and Zip™ disks, although these examples are not limiting.

As shown in FIG. 17, key holder 178 comprises a locking clip portion, to which one or more keys may be attached, and a ring portion rotatably mounted thereon. The ring portion is attached to rear wall portion 154 by a fabric loop 180, which preferably comprises nylon webbing. In part, key holder 178 provides a convenient place for storing a key, such as a spare house or automobile key, while traveling.

Writing implement holder 182 is adapted for holding pens, pencils and the like. Writing implement holder 182 preferably comprises an elastic fabric, such as an elastic nylon fabric, which is affixed in a folded manner to rear wall portion 154.

The retractable light comprises a locking clip portion 194, a cord housing 184 and a light housing 188. Locking clip portion 194 is permanently affixed to cord housing 184 and can be used to attach or remove the retractable light from a fabric loop 196 that is affixed to rear wall portion 154. Like fabric loop 180, fabric loop 196 preferably comprises nylon webbing.

Cord housing 184 houses a cord 186, a first end of which is affixed to the interior of cord housing 184 and the second end of which is coupled to light housing 188. Light housing 188 houses a light element, such as a light emitting diode (LED) bulb 192, and battery for powering the light source. Light housing 188 also includes an on/off switch 190 for turning the light source on and off. FIG. 17 shows the retractable light in a fully retracted position, while FIG. 18 shows the retractable light in an extended position. When released from an extended position, cord 186 will automatically return to cord housing 184. The retractable light provides a convenient light source that can be used at various times during travel. For example, the retractable light may be used for reading in a dark area (such as a plane or car at night), or for locating a lock on an automobile or dwelling at night.

Removable accessory pouch 160 provides removable storage for a variety of objects and is well-suited for the storage of portable computer components and accessories, such as a computer mouse and associated cord, power cables, and the like. Removable accessory pouch 160 has a front mesh cover that permits the contents thereof to be viewed without opening the pouch. Removable accessory pouch 160 also includes a rear wall having a strip of Velcro™ style material that mates with a corresponding strip of Velcro™ style material affixed to a bottom portion of rear wall portion 154. By mating these strips, removable accessory pouch 160 can be removably mounted within front interior storage compartment 20. Because pouch 160 is removable, it facilitates ease of access and organization of objects stored within front interior storage compartment 20.

FIG. 19 depicts an adjustable top restraint 202 that is provided within central interior storage compartment 22 for adjustably and resiliently biasing a laptop computer or other electronic equipment toward a bottom wall of compartment 22 and providing a shock or impact absorbing effect. Top restraint 202 includes a stretchable restraining member releasably connected between a back wall 200 and a front wall 198 of central interior storage compartment 22. Top restraint 202 includes first and second straps 204 and 206 of stretchable or elasticized material that may be secured to the inner surface of back wall 200 and front wall 198, respectively, or vice versa.

FIG. 20 depicts first strap 204 having first and second ends 208 and 210. As shown in FIG. 20, a first panel 214 of Velcro™ style material is affixed to first end 208 on a top portion 212 of first strap 204 and a second panel 216 of Velcro™ style material is affixed to second end 210 on top portion 212. First strap 204 can be adjustably mated to the inner surface of back wall 200 or front wall 198 of compartment 22, each of which is lined with a panel of Velcro™ style material, via either first panel 214 or second panel 216.

FIG. 21 depicts second strap 206 having first and second ends 218 and 220. As shown in FIG. 21, a first panel 222 of Velcro™ style material is affixed to first end 218 on a bottom portion 226 of second strap 206 and a second panel 228 of Velcro™ style material is affixed to second end 220 on a top portion 224 of second strap 206. Second strap 206 can be adjustably affixed to the inner surface of back wall 200 or front wall 198 of compartment 22 via second panel 228. First panel 222 is then used to mate second strap 206 with first or second panel 214 or 216 of first strap 204, which is affixed to the opposing compartment wall as described above. Together, the two straps 204 and 206 provide a means for adjustably and resiliently biasing a laptop computer or other electronic equipment toward a bottom wall of compartment 22 and providing a shock or impact absorbing effect.

Additional implementations of an adjustable top restraint that may be used to secure a laptop computer or other electronic equipment in a travel case in accordance with the present invention are found in commonly owned U.S. Pat. No. 6,131,734 to Hollingsworth et al., issued Oct. 17, 2000, and entitled "Carrying Case for Portable Computer and Impact Resistant Cushions for Use Therein," the entirety of which is incorporated by reference as if fully set forth herein.

FIG. 22 depicts first and second user-positionable, impact resistant, adjustable cushions 230 and 232 for supporting a portable computer device within central interior storage compartment 22 of travel case 10. First and second adjustable cushions 230 and 232 can be positioned at selected separations and angular orientations within storage compartment 22 to accommodate portable computers having different widths. Details concerning the structure and use of first and second adjustable cushions 230 and 232 can be found in commonly owned U.S. Pat. No. 6,334,534 to Hollingsworth et al., issued Jan. 1, 2002, and entitled "Carrying Case with Impact Resistant Support," the entirety of which is incorporated by reference as if fully set forth herein.

FIG. 23 illustrates a removable nylon file folder 162 that may be stored in rear interior storage compartment 23 of travel case 10. Removable file folder 162 provides a means for storing documents within travel case 10 in an organized manner, and providing easy and portable access thereto once the folder is removed from the case. As shown in FIG. 23, removable file folder 162 includes a front wall 234, a rear wall 236, and a front cover 238. Front wall 234 and rear wall 236 define an interior storage space which is subdivided by nylon dividers 240, 242 and 244 into compartments suitable for the storage of documents. Front cover 238 is attached to a top portion of rear wall 236 and is hinged so that it can fold over front wall 234, thereby closing the file folder 162. Front cover 238 may be temporarily affixed to front wall 234 by joining a first strip 246 of Velcro™ style material that is located on front cover 238 to a second strip 248 of Velcro™ style material that is located on front wall 234.

In an alternate embodiment of the present invention, rear anti-tip feet 36 and 38 are each replaced by a wheel assembly (not shown), thereby converting the travel case into a rolling travel case 10'. FIG. 24 illustrates a rear interior storage compartment 250 of rolling travel case 10' in accordance with such an embodiment. As shown in FIG. 24, rear interior storage compartment 250 includes first, second and third removable mesh pouches 252, 254, and 256, each of which is removably affixed to a rear wall 258 of storage compartment 250. In particular, each of the three removable mesh pouches has a back portion that includes an outward-facing strip of Velcro™ style material that allows the pouch to be removably affixed to rear wall 258, which is also lined with Velcro™ style material.

With reference to FIGS. 24 and 25, rear interior storage compartment 250 also includes a telescoping roller handle 260, which comprises a handle portion 266 and first and second telescoping arms 262 and 264. First telescoping arm 262 is housed in and is extendable from a first telescoping arm housing 266 and second telescoping arm 264 is housed in and is extendable from a second telescoping arm housing 268. FIG. 24 shows telescoping roller handle 260 in a non-extended position, in which it fits fully within the body of rear interior storage compartment 250, such that compartment 250 can be zippered shut. FIG. 25 shows telescoping roller handle 260 in a fully extended position, in which the handle emerges from a zippered opening 270 in the top of travel case 10' adapted for that purpose.

FIGS. 25 and 26 illustrate a manner in which a first travel case 10 in accordance with an embodiment of the present invention can be securely stacked on a second rolling travel case 10' in accordance with an embodiment of the present invention. As shown in FIG. 25, travel case 10 includes a rear side 272 and a rear panel 274 affixed thereto. A top portion of rear panel 274 is attached to rear side 272 by way of a first zippered opening 276 and a bottom portion of rear panel 274 is attached to rear side 272 by way of a second zippered opening 278. When first and second zippered openings 276 and 278 of travel case 10 are in an open position, extended telescoping roller handle 260 of rolling travel case 10' can be passed through the space defined between rear panel 274 and rear side 272, thereby allowing travel case 10 to be securely stacked on top of rolling travel case 10' in a manner that prevents travel case 10 from falling off rolling travel case 10' when rolling travel case 10' is in motion. Second zippered opening 278 is also preferably designed to be as wide as, or only slightly wider than, the width of telescoping roller handle 260, thereby reducing slipping of travel case 10 when stacked on top of rolling travel case 10' in the manner depicted in FIGS. 25 and 26.

D. CONCLUSION

While various embodiments of the present invention have been described above, it should be understood that they have been presented by way of example only, and not limitation. It will be understood by those skilled in the relevant art(s) that various changes in form and details may be made therein without departing from the spirit and scope of the invention as defined in the appended claims. Accordingly, the breadth and scope of the present invention should not be limited by any of the above-described exemplary embodiments, but should be defined only in accordance with the following claims and their equivalents.

What is claimed is:

1. A travel case, comprising:

a pocket accessible from a top portion of the travel case and disposed between a handle and an opening of an interior storage compartment to thereby dispose the pocket adjacent the opening of the interior storage compartment;

a document sleeve comprising a sleeve body, a first panel affixed to a front side of said sleeve body, said first panel and said front side of said sleeve body defining a first sleeve pocket, a pull tab attached to a top portion of said sleeve body, and a strip of elastic material having a first end affixed to said sleeve body and a second end affixed to a bottom portion of said pocket;

wherein said document sleeve can be extended from a retracted position in which the entirety of said sleeve body is within said pocket to an extended position in which at least a portion of said sleeve body is outside said pocket by pulling on said pull tab and thereby stretching said strip of elastic material, and wherein said sleeve body automatically returns to said retracted position upon release of said pull tab due to a constriction of said strip of elastic material.

2. The travel case of claim 1, wherein said document sleeve further comprises:

a second panel affixed to a front side of said first panel, said second panel and said front side of said first panel defining a second sleeve pocket.

3. The travel case of claim 2, wherein said second panel comprises a transparent plastic material.

4. The travel case of claim 1, wherein said pocket is located along a seam of said top portion of the travel case.

5. The travel case of claim 1, further comprising:

a bottle holder affixed to an inner wall of a side pocket thereof, said bottle holder comprising:

a bag;

a draw cord closure affixed to a top portion of said bag, said draw cord closure having an opening defined therein;

a circular draw cord comprising a first and second portion, wherein said first portion is enclosed by said draw cord closure and said second portion emerges from said opening in said draw cord closure and is external thereto;

a draw cord lock that encompasses said second portion of said circular draw cord and is slidably adjustable to shorten or lengthen said first portion of said circular draw cord, thereby tightening or loosening said draw cord closure, respectively;

wherein said bottle holder can be extended from a retracted position in which said bottle holder is within said side pocket of the travel case to an extended position in which at least a portion of said bottle holder is outside said side pocket.

6. The travel case of claim 1, further comprising:

a side storage compartment having at least one interior wall lined with a material adapted to prevent scratching of eyeglasses.

7. The travel case of claim 1, wherein the interior storage compartment houses a retractable light source.

8. The travel case of claim 7, wherein said retractable light source comprises:

a locking clip portion that is adapted for attachment to a rear wall of said interior storage compartment;

a cord housing affixed to said locking clip portion, said cord housing adapted to house a retractable cord; and a light housing coupled to an end of said retractable cord, said light housing adapted to house a light element and battery.

9. The travel case of claim 8, wherein said light element comprises a light emitting diode (LED) bulb.

10. The travel case of claim 1, wherein the interior storage compartment further comprises:

a plurality of pockets formed from overlaid flat panels of a non-woven material, said non-woven material adapted to minimize scratching of optical media stored in any of said plurality of pockets.

11. The travel case of claim 1, wherein the interior storage compartment further comprises:

an adjustable top restraint for securing portable computer devices of different sizes therein.

12. The travel case of claim 1, wherein the interior storage compartment further comprises:

an first and second user positionable, impact resistant, adjustable cushions adapted for supporting a portable computer device.

13. The travel case of claim 1, wherein the interior storage compartment further comprises:

a removable file folder therein.

14. The travel case of claim 1, further comprising:

a plurality of plastic feet affixed to a bottom of the travel case, each of said plastic feet including a base portion and a plurality of fins, wherein said plurality of plastic feet provide support for the travel case when placed in an upright position on a support surface.

15. A travel case, comprising:

a pocket accessible from a top portion of the travel case, said pocket defined within an interior storage compartment of the travel case, and said pocket disposed between a handle and an opening of said interior storage compartment;

a document sleeve comprising a sleeve body, a first panel affixed to a front side of said sleeve body, said first panel and said front side of said sleeve body defining a first sleeve pocket, a pull tab attached to a top portion of said sleeve body, and a strip of elastic material having a first end affixed to said sleeve body and a second end affixed to a bottom portion of said pocket;

wherein said document sleeve can be extended from a retracted position in which the entirety of said sleeve body is within said pocket to an extended position in which the entirety of said sleeve body is outside said pocket by pulling on said pull tab and thereby stretching said strip of elastic material;

wherein in said extended position said second end of said strip of elastic material remains affixed to a bottom portion of said pocket; and wherein said sleeve body automatically returns to said retracted position upon release of said pull tab due to a constriction of said strip of elastic material.

16. A travel case, comprising:

a pocket accessible from a top portion of the travel case and disposed between a handle and an opening of an interior storage compartment to thereby dispose the pocket adjacent the interior storage compartment, the pocket defining a pocket opening to the travel case which is disposed along a seam;

a document sleeve comprising a sleeve body, a first panel affixed to a front side of said sleeve body, said first panel and said front side of said sleeve body defining a first sleeve pocket, a pull tab attached to a top portion of said sleeve body, and a strip of elastic material having a first end affixed to said sleeve body and a second end affixed to a bottom portion of said pocket;

wherein said document sleeve can be extended from a retracted position in which the entirety of said sleeve body is within said pocket to an extended position in which at least a portion of said sleeve body is outside said pocket by pulling on said pull tab and thereby stretching said strip of elastic material, and wherein said sleeve body automatically returns to said retracted position upon release of said pull tab due to a constriction of said strip of elastic material.

* * * * *

UNITED STATES PATENT AND TRADEMARK OFFICE

CERTIFICATE OF CORRECTION

PATENT NO. : 7,503,440 B2
APPLICATION NO. : 10/939346
DATED : March 17, 2009
INVENTOR(S) : Todd M. Gormick et al.

It is certified that error appears in the above-identified patent and that said Letters Patent is hereby corrected as shown below:

Column 1, Line 26 reads, "For example, modem travel..." which should read, "For example, modern travel..."

Column 1, Line 58 reads, "...that houses an retractable light..." which should read, "...that houses a retractable light..."

Column 10, Line 36 reads, "D CONCLUSION" which should read, "CONLUSION"

Column 12, Line 3 reads, "an first and second user positionable..." which should read, "a first and second user positionable"

Signed and Sealed this

First Day of September, 2009

David J. Kappos

David J. Kappos
*Director of the United States Patent and Trademark Office*